US010293620B2

(12) United States Patent
Murayama et al.

(10) Patent No.: US 10,293,620 B2
(45) Date of Patent: May 21, 2019

(54) INKJET PRINTING APPARATUS AND INKJET PRINTING METHOD

(71) Applicant: CANON KABUSHIKI KAISHA, Tokyo, OT (JP)

(72) Inventors: Yoshiaki Murayama, Tokyo (JP); Satoshi Kitai, Kawasaki (JP); Masahiko Umezawa, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/657,512

(22) Filed: Jul. 24, 2017

(65) Prior Publication Data

US 2018/0043681 A1 Feb. 15, 2018

(30) Foreign Application Priority Data

Aug. 9, 2016 (JP) ..... 2016-156678

(51) Int. Cl.

| | |
|---|---|
| ***B41J 2/21*** | (2006.01) |
| ***B41J 2/045*** | (2006.01) |
| ***B41J 29/393*** | (2006.01) |
| ***B41J 2/15*** | (2006.01) |

(52) U.S. Cl.

CPC ..... *B41J 2/2139* (2013.01); *B41J 2/0458* (2013.01); *B41J 2/04525* (2013.01); *B41J 2/04545* (2013.01); *B41J 2/15* (2013.01); *B41J 2/2146* (2013.01); *B41J 29/393* (2013.01); *B41J 2/2107* (2013.01)

(58) Field of Classification Search

CPC ..... B41J 2/2139

See application file for complete search history.

(56) References Cited

U.S. PATENT DOCUMENTS

| | | | | |
|---|---|---|---|---|
| 6,533,380 | B1 * | 3/2003 | Hadimioglu | B41J 2/0451 347/12 |
| 7,866,779 | B2 * | 1/2011 | Martinez | B41J 2/5056 347/13 |
| 8,608,271 | B2 | 12/2013 | Murayama et al. | |
| 9,028,049 | B2 | 5/2015 | Azuma et al. | |
| 9,039,112 | B2 | 5/2015 | Murayama et al. | |
| 9,340,009 | B2 | 5/2016 | Murayama et al. | |

(Continued)

FOREIGN PATENT DOCUMENTS

JP 2010-269521 A 12/2010

*Primary Examiner* — Shelby L Fidler
(74) *Attorney, Agent, or Firm* — Venable LLP

(57) ABSTRACT

An inkjet printing apparatus uses a printing head including a plurality of nozzle arrays each including a plurality of nozzles arrayed in a first direction, the nozzle arrays being arranged in a second direction. A compensating unit compensates for an ejection failure of a defective nozzle by causing a compensating nozzle to eject ink to a predetermined pixel area in a case where the print data corresponding to the defective nozzle indicates ink ejection to the predetermined pixel area. The compensating unit determines the compensating nozzle such that the compensating nozzle satisfies both a first condition that the compensating nozzle is not a defective nozzle and a second condition that the print data indicates that nozzles belonging to the nozzle array including the compensating nozzle do not eject ink to a pixel area corresponding to N pixels (N is a positive integer) around the predetermined pixel area in the first direction.

16 Claims, 30 Drawing Sheets

(56) References Cited

U.S. PATENT DOCUMENTS

| | | | | |
|---|---|---|---|---|
| 9,434,196 | B2 | 9/2016 | Fukasawa et al. | |
| 2004/0100513 | A1* | 5/2004 | Kanematsu | B41J 2/0451 347/9 |
| 2007/0070108 | A1* | 3/2007 | Mantell | B41J 2/2139 347/19 |

* cited by examiner

| SEG \ NOZZLE | 0 | 1 | 2 | 3 | 4 | 5 | 6 | 7 |
|---|---|---|---|---|---|---|---|---|
| 0 | | | | | | | × | |
| 1 | | | × | × | | × | | × |
| 2 | | × | | | × | | | |
| 3 | | | | | | | | |
| 4 | | × | | | | × | | |
| 5 | | | × | × | | | | |
| 6 | | | | | | | | |
| 7 | | × | | | | × | | |
| 8 | × | | | | × | | | |
| 9 | | | | | | | | |
| 10 | | | | | | | | |
| 11 | | × | | | | | | |
| 12 | | × | | | | | | × |
| 13 | | | | | | | × | |
| 14 | | | | × | | | | |
| 15 | | × | | | | | | |

FIG.4

→ X LINE

| NOZZLE ARRAY | | | | | | | | |
|---|---|---|---|---|---|---|---|---|
| 0 | 5 | 6 | 7 | 0 | 1 | 2 | 3 | 4 |
| 1 | 4 | 5 | 6 | 7 | 0 | 1 | 2 | 3 |
| 2 | 3 | 4 | 5 | 6 | 7 | 0 | 1 | 2 |
| 3 | 2 | 3 | 4 | 5 | 6 | 7 | 0 | 1 |
| 4 | 1 | 2 | 3 | 4 | 5 | 6 | 7 | 0 |
| 5 | 0 | 1 | 2 | 3 | 4 | 5 | 6 | 7 |
| 6 | 7 | 0 | 1 | 2 | 3 | 4 | 5 | 6 |
| 7 | 6 | 7 | 0 | 1 | 2 | 3 | 4 | 5 |

FIG.7

A CLASS

→ X LINE

| NOZZLE ARRAY | | | | | | | | |
|---|---|---|---|---|---|---|---|---|
| 0 | 0 | 1 | 0 | 1 | 0 | 1 | 0 | 1 |
| 1 | 2 | 3 | 2 | 3 | 2 | 3 | 2 | 3 |
| 2 | 4 | 5 | 4 | 5 | 4 | 5 | 4 | 5 |
| 3 | 6 | 7 | 6 | 7 | 6 | 7 | 6 | 7 |
| 4 | 1 | 0 | 1 | 0 | 1 | 0 | 1 | 0 |
| 5 | 3 | 2 | 3 | 2 | 3 | 2 | 3 | 2 |
| 6 | 5 | 4 | 5 | 4 | 5 | 4 | 5 | 4 |
| 7 | 7 | 6 | 7 | 6 | 7 | 6 | 7 | 6 |

B CLASS

→ X LINE

| NOZZLE ARRAY | | | | | | | | |
|---|---|---|---|---|---|---|---|---|
| 0 | 4 | 5 | 4 | 5 | 4 | 5 | 4 | 5 |
| 1 | 0 | 1 | 0 | 1 | 0 | 1 | 0 | 1 |
| 2 | 2 | 3 | 2 | 3 | 2 | 3 | 2 | 3 |
| 3 | 6 | 7 | 6 | 7 | 6 | 7 | 6 | 7 |
| 4 | 5 | 4 | 5 | 4 | 5 | 4 | 5 | 4 |
| 5 | 1 | 0 | 1 | 0 | 1 | 0 | 1 | 0 |
| 6 | 3 | 2 | 3 | 2 | 3 | 2 | 3 | 2 |
| 7 | 7 | 6 | 7 | 6 | 7 | 6 | 7 | 6 |

C CLASS

→ X LINE

| NOZZLE ARRAY | | | | | | | | |
|---|---|---|---|---|---|---|---|---|
| 0 | 6 | 7 | 6 | 7 | 6 | 7 | 6 | 7 |
| 1 | 4 | 5 | 4 | 5 | 4 | 5 | 4 | 5 |
| 2 | 0 | 1 | 0 | 1 | 0 | 1 | 0 | 1 |
| 3 | 2 | 3 | 2 | 3 | 2 | 3 | 2 | 3 |
| 4 | 7 | 6 | 7 | 6 | 7 | 6 | 7 | 6 |
| 5 | 5 | 4 | 5 | 4 | 5 | 4 | 5 | 4 |
| 6 | 1 | 0 | 1 | 0 | 1 | 0 | 1 | 0 |
| 7 | 3 | 2 | 3 | 2 | 3 | 2 | 3 | 2 |

D CLASS

→ X LINE

| NOZZLE ARRAY | | | | | | | | |
|---|---|---|---|---|---|---|---|---|
| 0 | 6 | 7 | 6 | 7 | 6 | 7 | 6 | 7 |
| 1 | 4 | 5 | 4 | 5 | 4 | 5 | 4 | 5 |
| 2 | 2 | 3 | 2 | 3 | 2 | 3 | 2 | 3 |
| 3 | 0 | 1 | 0 | 1 | 0 | 1 | 0 | 1 |
| 4 | 7 | 6 | 7 | 6 | 7 | 6 | 7 | 6 |
| 5 | 5 | 4 | 5 | 4 | 5 | 4 | 5 | 4 |
| 6 | 3 | 2 | 3 | 2 | 3 | 2 | 3 | 2 |
| 7 | 1 | 0 | 1 | 0 | 1 | 0 | 1 | 0 |

FIG.25

A CLASS

→ X LINE

| NOZZLE ARRAY | | | | | | | | |
|---|---|---|---|---|---|---|---|---|
| 0 | 0 | 1 | 0 | 1 | 0 | 1 | 0 | 1 |
| 1 | 2 | 3 | 2 | 3 | 2 | 3 | 2 | 3 |
| 2 | 4 | 5 | 4 | 5 | 4 | 5 | 4 | 5 |
| 3 | | | | | | | | |
| 4 | 1 | 0 | 1 | 0 | 1 | 0 | 1 | 0 |
| 5 | 3 | 2 | 3 | 2 | 3 | 2 | 3 | 2 |
| 6 | 5 | 4 | 5 | 4 | 5 | 4 | 5 | 4 |
| 7 | | | | | | | | |

B CLASS

→ X LINE

| NOZZLE ARRAY | | | | | | | | |
|---|---|---|---|---|---|---|---|---|
| 0 | 4 | 5 | 4 | 5 | 4 | 5 | 4 | 5 |
| 1 | 0 | 1 | 0 | 1 | 0 | 1 | 0 | 1 |
| 2 | 2 | 3 | 2 | 3 | 2 | 3 | 2 | 3 |
| 3 | 6 | 7 | 6 | 7 | 6 | 7 | 6 | 7 |
| 4 | 5 | 4 | 5 | 4 | 5 | 4 | 5 | 4 |
| 5 | 1 | 0 | 1 | 0 | 1 | 0 | 1 | 0 |
| 6 | 3 | 2 | 3 | 2 | 3 | 2 | 3 | 2 |
| 7 | 7 | 6 | 7 | 6 | 7 | 6 | 7 | 6 |

C CLASS

→ X LINE

| NOZZLE ARRAY | | | | | | | | |
|---|---|---|---|---|---|---|---|---|
| 0 | 6 | 7 | 6 | 7 | 6 | 7 | 6 | 7 |
| 1 | 4 | 5 | 4 | 5 | 4 | 5 | 4 | 5 |
| 2 | 0 | 1 | 0 | 1 | 0 | 1 | 0 | 1 |
| 3 | 2 | 3 | 2 | 3 | 2 | 3 | 2 | 3 |
| 4 | 7 | 6 | 7 | 6 | 7 | 6 | 7 | 6 |
| 5 | 5 | 4 | 5 | 4 | 5 | 4 | 5 | 4 |
| 6 | 1 | 0 | 1 | 0 | 1 | 0 | 1 | 0 |
| 7 | 3 | 2 | 3 | 2 | 3 | 2 | 3 | 2 |

D CLASS

→ X LINE

| NOZZLE ARRAY | | | | | | | | |
|---|---|---|---|---|---|---|---|---|
| 0 | | | | | | | | |
| 1 | 4 | 5 | 4 | 5 | 4 | 5 | 4 | 5 |
| 2 | 2 | 3 | 2 | 3 | 2 | 3 | 2 | 3 |
| 3 | 0 | 1 | 0 | 1 | 0 | 1 | 0 | 1 |
| 4 | | | | | | | | |
| 5 | 5 | 4 | 5 | 4 | 5 | 4 | 5 | 4 |
| 6 | 3 | 2 | 3 | 2 | 3 | 2 | 3 | 2 |
| 7 | 1 | 0 | 1 | 0 | 1 | 0 | 1 | 0 |

FIG.27

A CLASS

→ X LINE

| NOZZLE ARRAY | | | | | | | | |
|---|---|---|---|---|---|---|---|---|
| 0 | 0 | 1 | 0 | 1 | 0 | 1 | 0 | 1 |
| 1 | 2 | 3 | 2 | 3 | 2 | 3 | 2 | 3 |
| 2 | | | | | | | | |
| 3 | | | | | | | | |
| 4 | 1 | 0 | 1 | 0 | 1 | 0 | 1 | 0 |
| 5 | 3 | 2 | 3 | 2 | 3 | 2 | 3 | 2 |
| 6 | | | | | | | | |
| 7 | | | | | | | | |

B CLASS

→ X LINE

| NOZZLE ARRAY | | | | | | | | |
|---|---|---|---|---|---|---|---|---|
| 0 | 4 | 5 | 4 | 5 | 4 | 5 | 4 | 5 |
| 1 | 0 | 1 | 0 | 1 | 0 | 1 | 0 | 1 |
| 2 | 2 | 3 | 2 | 3 | 2 | 3 | 2 | 3 |
| 3 | | | | | | | | |
| 4 | 5 | 4 | 5 | 4 | 5 | 4 | 5 | 4 |
| 5 | 1 | 0 | 1 | 0 | 1 | 0 | 1 | 0 |
| 6 | 3 | 2 | 3 | 2 | 3 | 2 | 3 | 2 |
| 7 | | | | | | | | |

C CLASS

→ X LINE

| NOZZLE ARRAY | | | | | | | | |
|---|---|---|---|---|---|---|---|---|
| 0 | | | | | | | | |
| 1 | 4 | 5 | 4 | 5 | 4 | 5 | 4 | 5 |
| 2 | 0 | 1 | 0 | 1 | 0 | 1 | 0 | 1 |
| 3 | 2 | 3 | 2 | 3 | 2 | 3 | 2 | 3 |
| 4 | | | | | | | | |
| 5 | 5 | 4 | 5 | 4 | 5 | 4 | 5 | 4 |
| 6 | 1 | 0 | 1 | 0 | 1 | 0 | 1 | 0 |
| 7 | 3 | 2 | 3 | 2 | 3 | 2 | 3 | 2 |

D CLASS

→ X LINE

| NOZZLE ARRAY | | | | | | | | |
|---|---|---|---|---|---|---|---|---|
| 0 | | | | | | | | |
| 1 | | | | | | | | |
| 2 | 2 | 3 | 2 | 3 | 2 | 3 | 2 | 3 |
| 3 | 0 | 1 | 0 | 1 | 0 | 1 | 0 | 1 |
| 4 | | | | | | | | |
| 5 | | | | | | | | |
| 6 | 3 | 2 | 3 | 2 | 3 | 2 | 3 | 2 |
| 7 | 1 | 0 | 1 | 0 | 1 | 0 | 1 | 0 |

FIG.28

A CLASS

→ X LINE

| NOZZLE ARRAY | | | | | | | | |
|---|---|---|---|---|---|---|---|---|
| 0 | 0 | 1 | 0 | 1 | 0 | 1 | 0 | 1 |
| 1 | | | | | | | | |
| 2 | | | | | | | | |
| 3 | | | | | | | | |
| 4 | 1 | 0 | 1 | 0 | 1 | 0 | 1 | 0 |
| 5 | | | | | | | | |
| 6 | | | | | | | | |
| 7 | | | | | | | | |

B CLASS

→ X LINE

| NOZZLE ARRAY | | | | | | | | |
|---|---|---|---|---|---|---|---|---|
| 0 | | | | | | | | |
| 1 | 0 | 1 | 0 | 1 | 0 | 1 | 0 | 1 |
| 2 | | | | | | | | |
| 3 | | | | | | | | |
| 4 | | | | | | | | |
| 5 | 1 | 0 | 1 | 0 | 1 | 0 | 1 | 0 |
| 6 | | | | | | | | |
| 7 | | | | | | | | |

C CLASS

→ X LINE

| NOZZLE ARRAY | | | | | | | | |
|---|---|---|---|---|---|---|---|---|
| 0 | | | | | | | | |
| 1 | | | | | | | | |
| 2 | 0 | 1 | 0 | 1 | 0 | 1 | 0 | 1 |
| 3 | | | | | | | | |
| 4 | | | | | | | | |
| 5 | | | | | | | | |
| 6 | 1 | 0 | 1 | 0 | 1 | 0 | 1 | 0 |
| 7 | | | | | | | | |

D CLASS

→ X LINE

| NOZZLE ARRAY | | | | | | | | |
|---|---|---|---|---|---|---|---|---|
| 0 | | | | | | | | |
| 1 | | | | | | | | |
| 2 | | | | | | | | |
| 3 | 0 | 1 | 0 | 1 | 0 | 1 | 0 | 1 |
| 4 | | | | | | | | |
| 5 | | | | | | | | |
| 6 | | | | | | | | |
| 7 | 1 | 0 | 1 | 0 | 1 | 0 | 1 | 0 |

FIG.29

INKJET PRINTING APPARATUS AND INKJET PRINTING METHOD

BACKGROUND OF THE INVENTION

Field of the Invention

The present invention relates to an inkjet printing apparatus and an inkjet printing method.

Description of the Related Art

Japanese Patent Laid-Open No. 2010-269521 discloses a method of efficiently compensating for an ejection failure with a small amount of memory in a full-line inkjet printing apparatus, and more specifically, a method of arranging a plurality of nozzle arrays that eject the same type of ink in the direction of conveyance of sheets and, if an ejection failure occurs in a nozzle in a nozzle array, efficiently compensating for the failure with a small memory by using another nozzle capable of printing data to be printed by the defective nozzle at the same position.

However, in Japanese Patent Laid-Open No. 2010-269521, the other nozzle compensates for the failure by printing data to be printed by the defective nozzle without particularly considering the drive state of the compensating nozzle array. As a result, ejection operation of the compensating nozzle array often becomes unstable. The specific examples will be described below.

For example, each nozzle in an inkjet printing head requires refill time to refill the nozzle with ink to a predetermined position to compensate for ink consumption by the ejection operation. The ejection frequency (drive frequency) of a nozzle is generally adjusted based on the length of the refill time. In the configuration disclosed in Japanese Patent Laid-Open No. 2010-269521 including nozzle arrays that eject the same type of ink, nozzles perform ejection operation in rotation, which allows an image to be printed faster than the case of printing an image by one nozzle array. However, if new ejection data is added to a nozzle in the ejection failure compensation process, there is a possibility that the drive frequency of the nozzle increases, sufficient refill time cannot be secured, and suitable ejection operation cannot be performed, depending on the drive state of nozzles prior to and subsequent to the nozzle.

Further, it is known that vibrations generated by ejection operation of a nozzle in an inkjet printing head are transmitted to adjacent nozzles sharing an ink supply path (this phenomenon is called crosstalk). For this reason, many inkjet printing apparatuses are devised such that adjacent nozzles perform ejection operation with an interval to the extent possible. However, if new ejection data is added to a nozzle in the ejection failure compensation process, there is a possibility that suitable ejection operation cannot be performed due to crosstalk depending on the drive state of nozzles around the nozzle.

In short, even if the adoption of the method disclosed in Japanese Patent Laid-Open No. 2010-269521 makes it possible to compensate for an ejection failure using print data for a defective nozzle, Japanese Patent Laid-Open No. 2010-269521 does not sufficiently consider a condition for stable ejection operation of a compensating nozzle array and therefore the ejection state of the nozzle array may become unstable as a whole.

SUMMARY OF THE INVENTION

The present invention has been accomplished in order to solve the above problem. Accordingly, the present invention aims to provide an inkjet printing apparatus and an inkjet printing method capable of reliably compensating for an ejection failure while maintaining stable ejection operation in a nozzle array.

According to a first aspect of the present invention, there is provided an inkjet printing apparatus using a printing head including a plurality of nozzle arrays each including a plurality of nozzles configured to eject ink and arrayed in a first direction, the nozzle arrays being arranged in a second direction intersecting with the first direction, to print an image on a print medium while relatively moving at least one of the printing head and the print medium in the second direction, the inkjet printing apparatus comprising: a generation unit configured to generate print data corresponding to each of the nozzle arrays and indicating whether or not to eject ink to each pixel on the print medium; an acquisition unit configured to acquire information on a defective nozzle included in the printing head; and a compensating unit configured to compensate for an ejection failure of the defective nozzle by causing a compensating nozzle different from the defective nozzle to eject ink to a predetermined pixel area on the print medium in a case where the print data corresponding to the defective nozzle indicates ink ejection to the predetermined pixel area, wherein the compensating unit determines the compensating nozzle such that the compensating nozzle satisfies both a first condition that the compensating nozzle is not a defective nozzle and a second condition that the print data indicates that nozzles belonging to the nozzle array including the compensating nozzle do not eject ink to a pixel area corresponding to N pixels (N is a positive integer) around the predetermined pixel area in the first direction.

According to a second aspect of the present invention, there is provided an inkjet printing apparatus using a printing head including a plurality of nozzle arrays each including a plurality of nozzles configured to eject ink and arrayed in a first direction, the nozzle arrays being arranged in a second direction intersecting with the first direction, to print an image on a print medium while relatively moving at least one of the printing head and the print medium in the second direction, the inkjet printing apparatus comprising: a generation unit configured to generate print data corresponding to each of the nozzle arrays and indicating whether or not to eject ink to each pixel on the print medium; an acquisition unit configured to acquire information on a defective nozzle included in the printing head; and a compensating unit configured to compensate for an ejection failure of the defective nozzle by causing a compensating nozzle different from the defective nozzle to eject ink to a predetermined pixel area on the print medium in a case where the print data corresponding to the defective nozzle indicates ink ejection to the predetermined pixel area, wherein the compensating unit determines the compensating nozzle such that the compensating nozzle satisfies both a first condition that the compensating nozzle is not a defective nozzle and a second condition that the print data indicates that the compensating nozzle does not eject ink to M pixels (M is a positive integer) around the predetermined pixel area in the second direction.

According to a third aspect of the present invention, there is provided an inkjet printing apparatus using a printing head including a nozzle array including a plurality of nozzles configured to eject ink and arrayed in a first direction to print an image on a print medium while making multiple relative movements of at least one of the printing head and the print medium in a second direction intersecting with the first direction, the inkjet printing apparatus comprising: a generation unit configured to generate print data corresponding to each of the movements and indicating whether or not to eject ink to each pixel on the print medium; an acquisition unit configured to acquire information on a defective nozzle included in the printing head; and a compensating unit configured to, in a case where the print data corresponding to the defective nozzle indicates ink ejection to a predetermined pixel area during a predetermined movement, compensate for an ejection failure of the defective nozzle by causing a compensating nozzle different from the defective nozzle to eject ink to the predetermined pixel area on the print medium during a movement different from the predetermined movement, wherein the compensating unit determines the compensating nozzle such that the compensating nozzle satisfies both a first condition that the compensating nozzle is not a defective nozzle and a second condition that the print data indicates that N nozzles (N is a positive integer) adjustment to the compensating nozzle in the first direction do not eject ink at the same time during any one of the multiple movements.

According to a fourth aspect of the present invention, there is provided an inkjet printing apparatus using a printing head including a nozzle array including a plurality of nozzles configured to eject ink and arrayed in a first direction to print an image on a print medium while making multiple relative movements of at least one of the printing head and the print medium in a second direction intersecting with the first direction, the inkjet printing apparatus comprising: a generation unit configured to generate print data corresponding to each of the movements and indicating whether or not to eject ink to each pixel on the print medium; an acquisition unit configured to acquire information on a defective nozzle included in the printing head; and a compensating unit configured to, in a case where the print data corresponding to the defective nozzle indicates ink ejection to a predetermined pixel area during a predetermined movement, compensate for an ejection failure of the defective nozzle by causing a compensating nozzle different from the defective nozzle to eject ink to the predetermined pixel area on the print medium during a movement different from the predetermined movement, wherein the compensating unit determines the compensating nozzle such that the compensating nozzle satisfies both a first condition that the compensating nozzle is not a defective nozzle and a second condition that the print data indicates that the compensating nozzle does not eject ink to M pixels (M is a positive integer) adjustment to the predetermined pixel area in the second direction during the same movement.

According to a fifth aspect of the present invention, there is provided an inkjet printing method using a printing head including a plurality of nozzle arrays each including a plurality of nozzles configured to eject ink and arrayed in a first direction, the nozzle arrays being arranged in a second direction intersecting with the first direction, to print an image on a print medium while relatively moving at least one of the printing head and the print medium in the second direction, the inkjet printing method comprising the steps of: generating print data corresponding to each of the nozzle arrays, the print data indicating whether or not to eject ink to each pixel on the print medium; acquiring information on a defective nozzle included in the printing head; and compensating for an ejection failure of the defective nozzle by causing a compensating nozzle different from the defective nozzle to eject ink to a predetermined pixel area on the print medium in a case where the print data corresponding to the defective nozzle indicates ink ejection to the predetermined pixel area, wherein the compensating step comprises determining the compensating nozzle such that the compensating nozzle satisfies both a first condition that the compensating nozzle is not a defective nozzle and a second condition that the print data indicates that nozzles belonging to the nozzle array including the compensating nozzle do not eject ink to a pixel area corresponding to N pixels (N is a positive integer) around the predetermined pixel area in the first direction.

According to a sixth aspect of the present invention, there is provided an inkjet printing method using a printing head including a plurality of nozzle arrays each including a plurality of nozzles configured to eject ink and arrayed in a first direction, the nozzle arrays being arranged in a second direction intersecting with the first direction, to print an image on a print medium while relatively moving at least one of the printing head and the print medium in the second direction, the inkjet printing method comprising the steps of: generating print data corresponding to each of the nozzle arrays, the print data indicating whether or not to eject ink to each pixel on the print medium; acquiring information on a defective nozzle included in the printing head; and compensating for an ejection failure of the defective nozzle by causing a compensating nozzle different from the defective nozzle to eject ink to a predetermined pixel area on the print medium in a case where the print data corresponding to the defective nozzle indicates ink ejection to the predetermined pixel area, wherein the compensating step comprises determining the compensating nozzle such that the compensating nozzle satisfies both a first condition that the compensating nozzle is not a defective nozzle and a second condition that the print data indicates that the compensating nozzle does not eject ink to M pixels (M is a positive integer) around the predetermined pixel area in the second direction.

Further features of the present invention will become apparent from the following description of exemplary embodiments with reference to the attached drawings.

BRIEF DESCRIPTION OF THE DRAWINGS

FIG. 4 is a diagram showing an example of ejection failure information;

FIG. 7 is a diagram showing an example of a priority table;

FIG. 25 is a diagram showing priority information for each class;

FIG. 27 is a diagram showing another example of the priority information;

FIG. 28 is a diagram showing a further example of the priority information;

FIG. 29 is a diagram showing a still further example of the priority information.

DESCRIPTION OF THE EMBODIMENTS (First Embodiment)

Figure 1A:
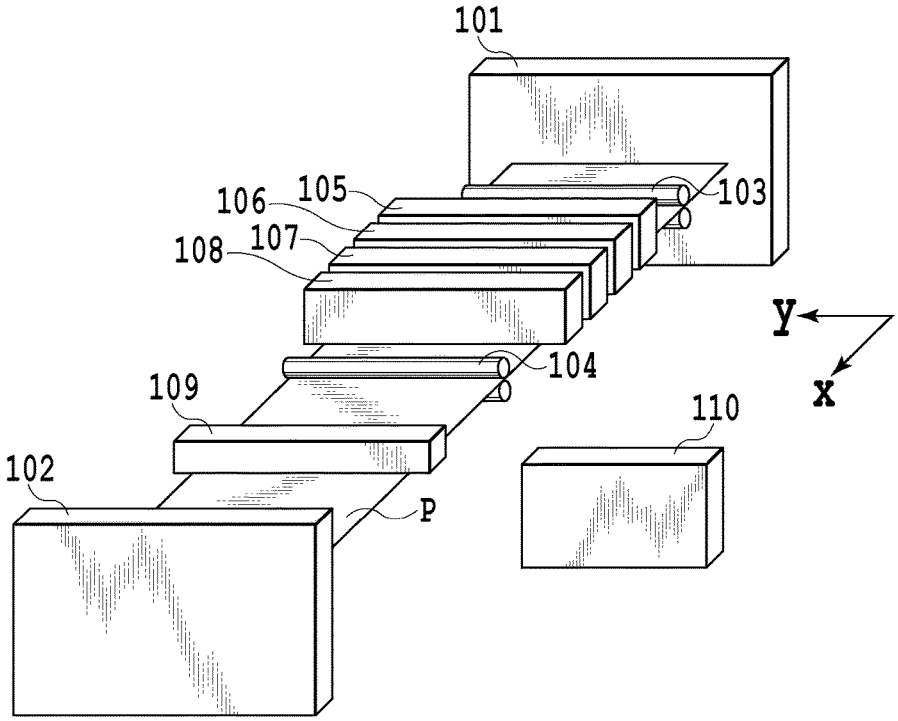
FIGS. 1A and 1B are schematic diagrams showing the internal configuration of an inkjet printing apparatus.

FIG. 1A is a diagram showing the internal configuration of a full-line inkjet printing apparatus used in the present embodiment. A sheet P (print medium) fed from a sheet feeding unit 101 is conveyed in an x direction at a predetermined speed while being held by conveying roller pairs 103 and 104 and is then discharged from a discharging unit 102. In the direction of conveyance (+x direction), printing heads 105 to 108 are arranged between the upstream conveying roller pair 103 and the downstream conveying roller pair 104 to eject ink in a z direction based on print data. The printing heads 105 to 108 eject ink of cyan, magenta, yellow, and black. The ink of each color is supplied through a tube (not shown).

In the present embodiment, the sheet P may be a continuous sheet wound in a roll in the sheet feeding unit 101 or may be a sheet cut in advance according to a standard size. In the case of the continuous sheet, the sheet P is cut by a cutter 109 into a predetermined length after the printing operation of the printing heads 105 to 108 and sorted into an output tray by size in the discharging unit 102. A printing control unit 110 controls all the mechanisms of the printing apparatus such as the printing heads 105 to 108, conveying motors for rotating the conveying roller pairs 103 and 104, the sheet feeding unit 101, and the output unit 102.

Figure 1B:
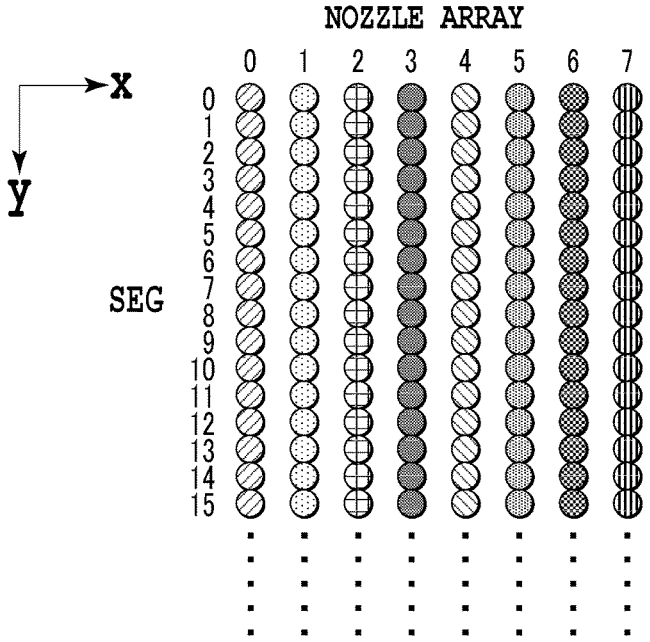

FIG. 1B is a diagram schematically showing arrays of nozzles in the printing head 105. Each circle represents a nozzle that ejects ink as a droplet. In the printing head 105, eight nozzle arrays, each including nozzles arrayed in a y direction by a number corresponding to the width of a sheet, are arranged in the x direction. The eight nozzle arrays are hereinafter referred to as nozzle arrays 0 to 7, respectively. The SEG numbers indicate pixel positions (nozzle positions) in the y direction. Nozzles having the same SEG number can print a dot at substantially the same position on a sheet conveyed in the x direction. The printing control unit 110 allocates each piece of print data to any of eight nozzles capable of printing the piece of print data. Since the other printing heads 106 to 108 have the same configuration as that of the printing head 105, their description is omitted.

FIG. 1B shows that nozzles included in the same nozzle array are aligned in the y direction for the sake of simplification. However, the printing head of the present embodiment is not limited to this. For example, nozzles included in the same nozzle array may be arrayed in the y direction while being alternately shifted in the x direction. Alternatively, nozzle substrates each including a plurality of nozzles may be arranged in the y direction. Either case can be applied to the present embodiment as long as eight nozzles corresponding to each pixel position (SEG) in the y direction are prepared. As an ink ejection system, a system using a heating element, a piezo element, an electrostatic element, a MEMS element or the like may be adopted.

Figure 2:
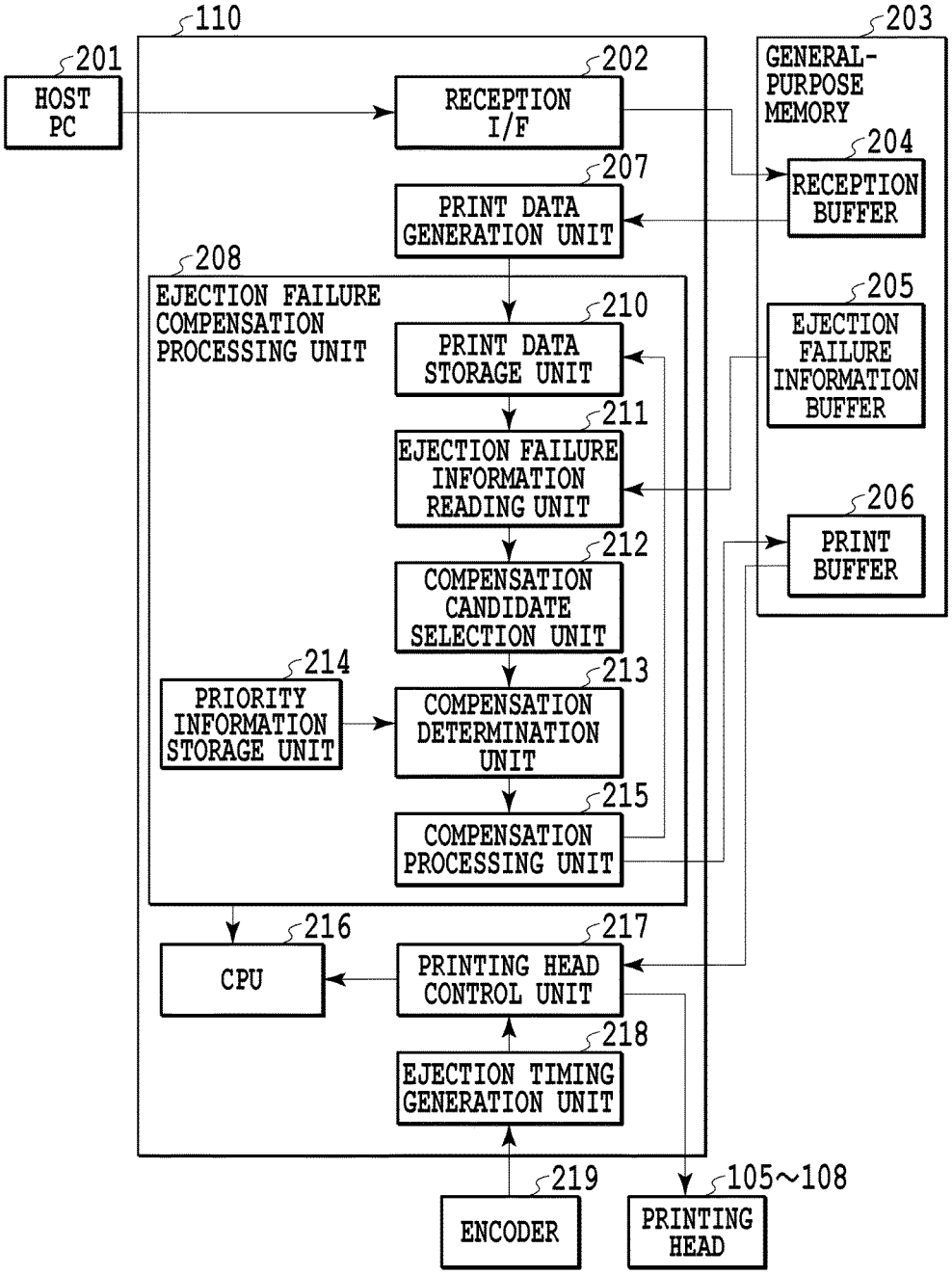
FIG. 2 is a block diagram showing the control configuration of the inkjet printing apparatus.

FIG. 2 is a block diagram showing the control configuration of the inkjet printing apparatus. The printing control unit 110 has various mechanisms to control the entire printing apparatus under instructions from a CPU 216. A general-purpose memory 203 including a DRAM or the like is used as a work area.

The CPU 216 receives image data to be printed from an externally connected host apparatus 201 via a reception I/F and stores the image data in a reception buffer 204 in the general-purpose memory 203. Then, the CPU 216 uses a print data generation unit 207 to subject the image data to various types of image processing to generate binary print data printable by the printing heads 105 to 108, and stores the generated print data in a print buffer 206. At this time, the print data generation unit 207 uses predetermined mask data to allocate a piece of print data corresponding to each ink color to any of the nozzle arrays 0 to 7.

Figure 3A:
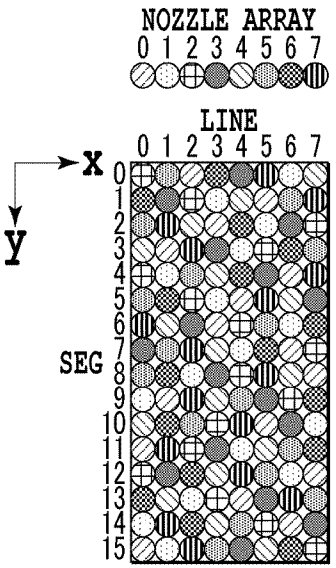
FIGS. 3A and 3B are diagrams showing an example of mask data.

FIG. 3A is a diagram showing an example of the mask data used by the print data generation unit 207. In the present embodiment, it is assumed that an image is printed at a resolution of 600 dpi. In FIG. 3A, the horizontal axis indicates pixel positions in the direction of conveyance (x direction) and the vertical axis indicates pixel positions in the direction of nozzle arrays (y direction), namely nozzle positions (SEG). Each circle indicates by its pattern any of the nozzle arrays 0 to 7 to be used to print a dot. In the y direction, FIG. 3A only shows sixteen nozzle positions SEG0 to SEG15, but mask data corresponding to all the nozzles arrayed in the y direction is actually prepared. In the x direction, the mask data shown in FIG. 3A may be repeated or larger mask data may be prepared. The mask data is generated such that the print data is equally allocated to the nozzle arrays 0 to 7.

Figure 3B:
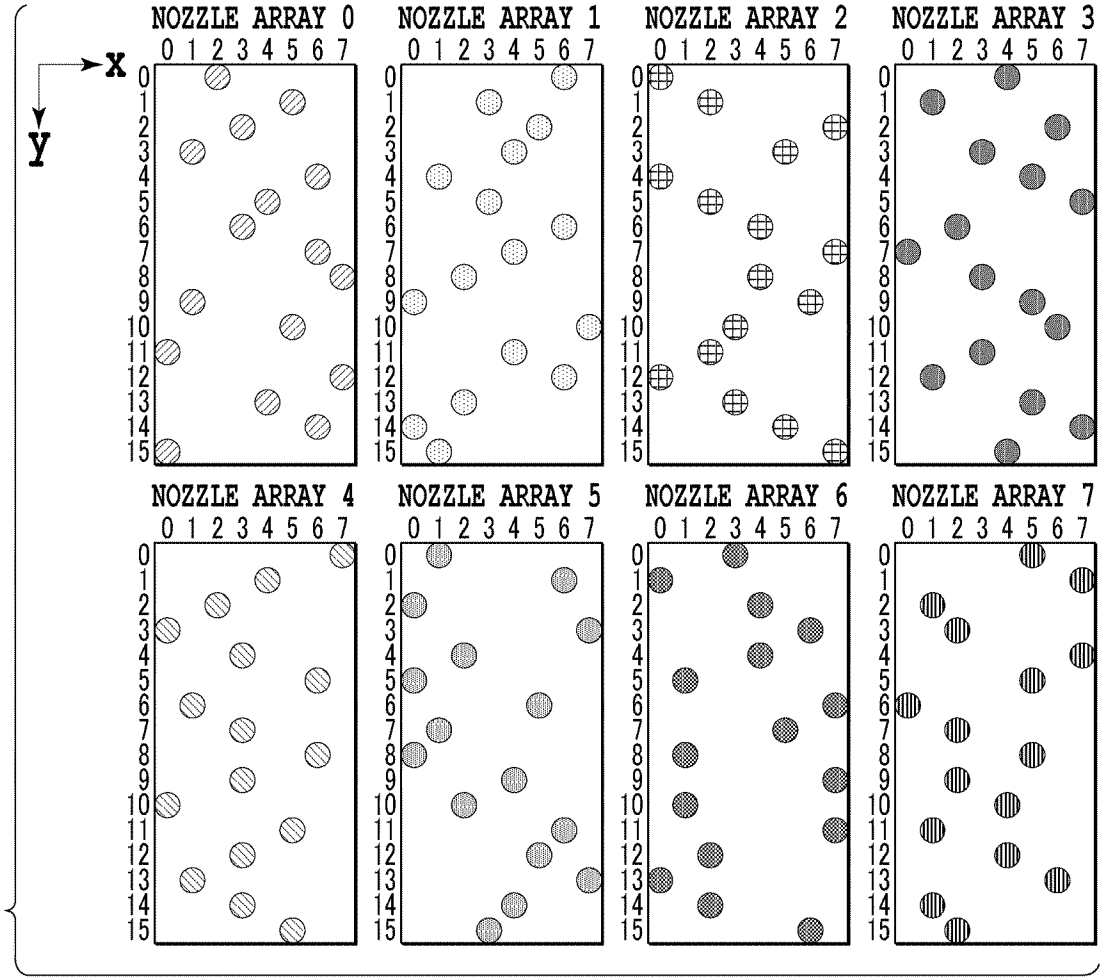

FIG. 3B is a diagram showing the print data generated by the print data generation unit 207 for each nozzle array. FIG. 3B shows a case where data indicating print (1) is input to all the pixels. Such 100% print data is allocated to the nozzle arrays 0 to 7 by using the mask data shown in FIG. 3B. In FIG. 3B, only pixel positions at which dots are printed are marked with circles in each of the nozzle arrays 0 to 7.

On the assumption that a rate of pixels at which one nozzle performs ejection operation is defined as a drive rate R, the mask data is defined such that the eight nozzle arrays are equal in the drive rate R, that is, $R \leq 1/8 = 0.125$, in the present embodiment.

Returning to FIG. 2, a printing head control unit 217 drives the printing heads 105 to 108 based on the print data generated by the print data generation unit 207 and stored in the print buffer 206 as shown in FIG. 3B. At this time, an encoder 219 detects a conveyance speed of the sheet P and provides the acquired information to an ejection timing generation unit 218. The printing head control unit 217 controls ejection timings of nozzles based on the information. As a result, ink is ejected from nozzles corresponding to a specified ink color at a specified timing, thereby forming a desired image on the sheet.

An ejection failure compensation processing unit 208 executes a characteristic ejection failure compensation process of the present invention based on ejection failure information stored in an ejection failure information buffer 205 and corrects the print data temporally stored in the print buffer 206. The ejection failure compensation process of the present embodiment will be described below in detail.

FIG. 4 shows an example of the ejection failure information prestored in the ejection failure information buffer 205. In the ejection failure information buffer 205, memory areas corresponding to respective nozzles (SEG) are prepared for each of the nozzle arrays 0 to 7, and each memory area stores information indicating whether or not a corresponding nozzle normally ejects ink. In FIG. 4, nozzles that do not normally eject ink are marked with crosses. In the description below, a nozzle in which an ink ejection failure occurs and a nozzle in which a shift in the direction of ink ejection occurs are referred to as defective nozzles.

If there is no defective nozzle, the content of the ejection failure information buffer 205 is NULL. In this case, the printing head control unit 217 drives the printing heads 105 to 108 based on the print date generated by the print data generation unit 207 without any change. In contrast, if there is a defective nozzle, the ejection failure compensation processing unit 208 corrects the print data generated by the print data generation unit 207 based on the information stored in the ejection failure information buffer 205. More specifically, the ejection failure compensation processing unit 208 rewrites print data corresponding to the defective nozzle as print data for another nozzle capable of printing a dot at the same position as the defective nozzle.

Returning to FIG. 2, the ejection failure compensation processing unit 208 mainly includes a print data storage unit 210, an ejection failure information reading unit 211, a compensation candidate selection unit 212, a compensation determination unit 213, a priority information storage unit 214, and a compensation processing unit 215. The print data storage unit 210 sequentially receives and stores print data generated by the print data generation unit 207. The ejection failure information reading unit 211 accesses the ejection failure information buffer 205 and acquires the ejection failure information as shown in FIG. 4. The compensation candidate selection unit 212, in a case where a pixel to be processed corresponds to a defective nozzle read by the ejection failure information reading unit 211, selects candidates for a nozzle capable of printing print data for the pixel. In the present embodiment, out of seven nozzles included in nozzle arrays different from a nozzle array including the defective nozzle and having the same SEG number as the defective nozzle, nozzles that can be normally refilled are selected as nozzle candidates.

Figure 5A:
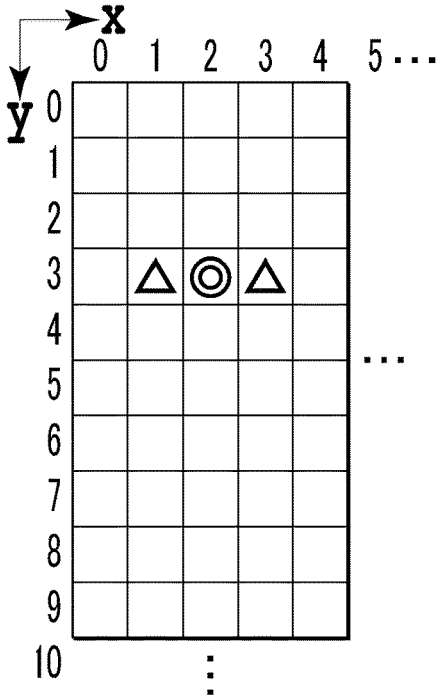
FIGS. 5A and 5B are diagrams showing conditions for normal refilling.
Figure 5B:
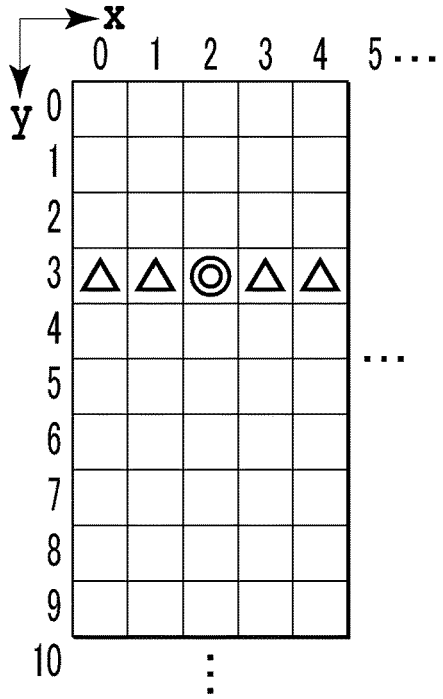

FIGS. 5A and 5B are diagrams showing conditions for nozzles that can be normally refilled. In both FIGS. 5A and 5B, the horizontal axis indicates the pixel positions in the x direction and the vertical axis indicates the pixel positions (SEG) in the y direction. For each of nozzles (SEG), in a case of printing a dot at a pixel position (x), whether the nozzle can print a dot at pixel positions around the pixel position in the ±x directions depends on refill time of the nozzle.

FIG. 5A shows a case where nozzles can be refilled within non-ejection time of one pixel. In the drawings, a pixel at which a dot is determined to be printed is represented by a double circle, and pixels that the compensation candidate selection unit 212 excludes from ejection failure compensation candidates are represented by triangles. If a dot is to be printed at a pixel immediately prior to or subsequent to ⊙ pixel at which a dot is determined to be printed, there is a possibility that a nozzle is not refilled by the time of printing a succeeding pixel due to the ejection operation of a preceding pixel, which may result in abnormal ejection. Accordingly, in the present embodiment, a nozzle corresponding to ⊙ pixel at which a dot is determined to be printed and two pixels (Δ pixels) prior to or subsequent to ⊙ pixel is excluded from ejection failure compensation candidates. Nozzles corresponding to pixels apart from ⊙ pixel at which a dot is determined to be printed by one or more pixels are included in ejection failure compensation candidates because sufficient refill time can be secured.

FIG. 5B shows a case where nozzles can be refilled within non-ejection time of two pixels. In this case, a nozzle corresponding to ⊙ pixel at which a dot is determined to be printed and two pixels (Δ pixels) prior to or subsequent to ⊙ pixel are excluded from ejection failure compensation candidates. Pixels apart from ⊙ pixel by three or more pixels are included in ejection failure compensation candidates. The following description is based on the premise that nozzles can be refilled within non-ejection time of one pixel as shown in FIG. 5A.

Figure 6B:
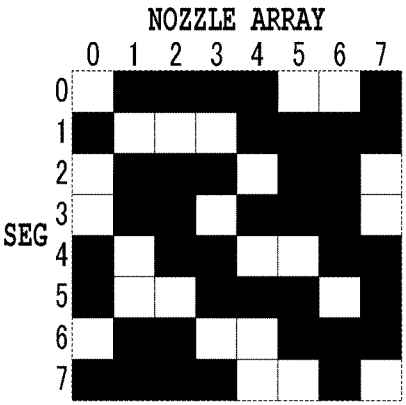
FIGS. 6A and 6B are diagrams showing a state where compensating nozzle candidates are selected.
Figure 6A:
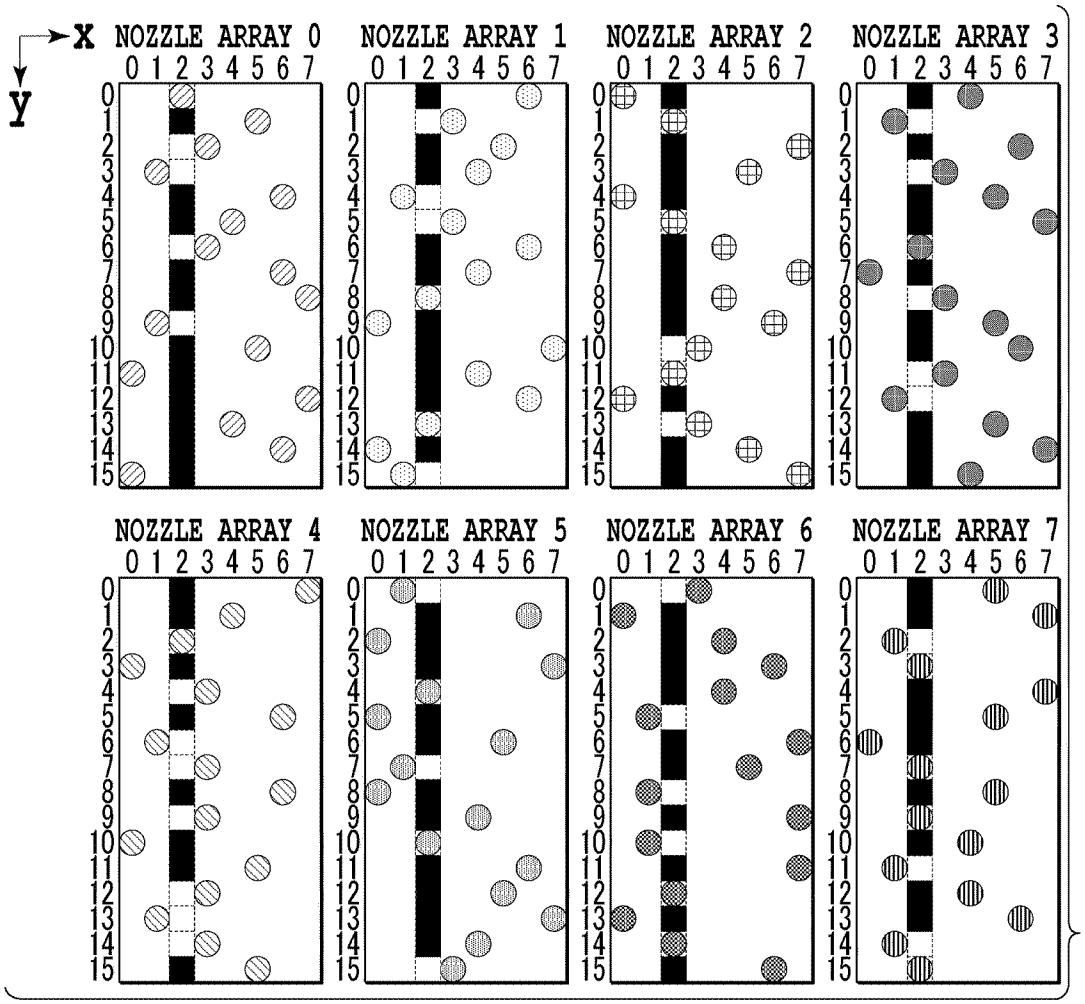

FIG. 6A is a diagram showing a state where the compensation candidate selection unit 212 selects compensating nozzle candidates for each nozzle array. FIG. 6A shows the selection of compensating nozzle candidates only for a line of x=2. In either nozzle array, nozzles having print data ○ for any of a pixel of x=2 and preceding and succeeding pixels, namely, any of pixels of x=1 to 3, are not selected as ejection failure compensation candidates for the pixel of x=2. Nozzles having no print data in the pixels of x=1 to 3 are selected as ejection failure compensation candidates for the pixel of x=2. In FIG. 6A, pixels selected as candidates are represented by solid black squares for each of nozzles.

FIG. 6B is a diagram showing the resultant candidates for the line of x=2 shown in FIG. 6A, arranged according to the nozzle arrays 0 to 7. In FIG. 6B, the horizontal axis indicates the nozzle array numbers and the vertical axis indicates the nozzle positions (y). In FIG. 6B, nozzles in black represent nozzles selected as candidates for an ejection failure compensating nozzle for the line of x=2 and nozzles in white represent nozzles excluded from the candidates. The compensation candidate selection unit 212 generates such information on the candidates for an ejection failure compensating nozzle and provides the information to a compensation determination unit 213.

Returning to FIG. 2, the compensation determination unit 213 determines a nozzle to be used for ejection failure compensation based on the candidate information provided from the compensation candidate selection unit 212 as shown in FIG. 6B and priority information stored in the priority information storage unit 214.

FIG. 7 is a diagram showing an example of a priority table stored in the priority information storage unit 214. The horizontal axis indicates the pixel (line) positions in the x direction and the vertical axis indicates the nozzle array numbers (0 to 7). A number in each square indicates a priority of a corresponding nozzle array in a corresponding pixel line for becoming a compensating nozzle. For example, if an ejection failure occurs in the line of x=2, priorities are set such that a nozzle array that compensates for the failure using corresponding print data is selected in the order of a nozzle array 7 (0), a nozzle array 6 (1), a nozzle array 5 (2) . . . . The compensation determination unit 213 determines a compensating nozzle from the nozzles selected as candidates by the compensation candidate selection unit 212 based on the priorities set in the priority table. It is assumed that the information on lines of x=0 to 7 shown in FIG. 7 is repeatedly used for lines of x=8 onward in the priority table.

Figure 8:
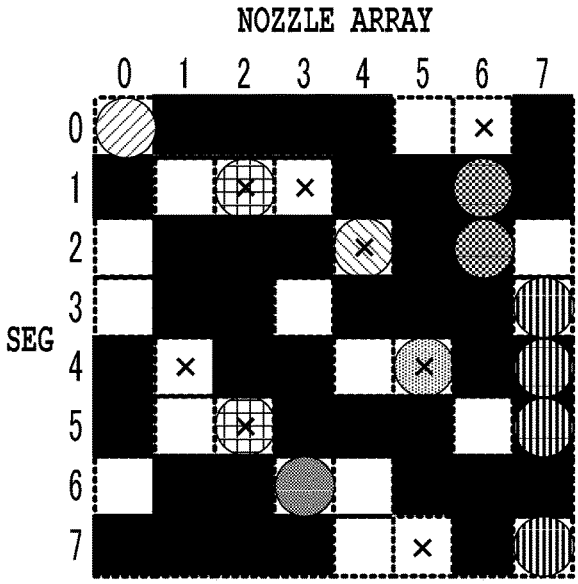
FIG. 8 is a diagram showing a state where a compensation determination unit determines a compensating nozzle.

FIG. 8 is a diagram showing a state where the compensation determination unit 213 determines a compensating nozzle. FIG. 8 shows the ejection failure nozzle information shown in FIG. 4 overlapping the compensation candidate information for the line of x=2 shown in FIG. 6B. For example, the print data generation unit 207 allocates print data to a nozzle at SEG 1 of the nozzle array 2, but the nozzle is defective. The compensation determination unit 213 first refers to the line of x=2 in the priority information shown in FIG. 7. Since the nozzle array 7 (priority 0) has the highest priority in the line of x=2, the compensation determination unit 213 confirms whether the nozzle array 7 can normally eject ink and whether the nozzle array 7 is selected as a compensation candidate in the line of x=2. In this case, a nozzle at SEG1 of the nozzle array 7 is also defective (x). Accordingly, the compensation determination unit 213 confirms whether the nozzle array 6 (priority 1) having the second highest priority can normally eject ink and whether the nozzle array 6 is selected as a compensation candidate in the line of x=2. In this case, a nozzle at SEG1 of the nozzle array 6 can normally eject ink and is selected as a compensation candidate (black) in the line of x=2. Therefore, the compensation determination unit 213 sets the nozzle at SEG1 of the nozzle array 6 as a compensating nozzle for the defective nozzle (SEG1) of the nozzle array 2 in the line of x=2. The same process is executed for other defective nozzles.

Returning to FIG. 2, after the compensation determination unit 213 determines a compensating nozzle, the compensation processing unit 215 transfers print data allocated to the defective nozzle to the nozzle determined by the compensation determination unit 213. In other words, the compensation processing unit 215 deletes the print data for the defective nozzle from a print buffer for the nozzle array including the defective nozzle and adds the print data to a print buffer for the nozzle array including the nozzle determined by the compensation priority determination unit 213. The above is the main function of the ejection failure compensation processing unit 208.

Figure 9:
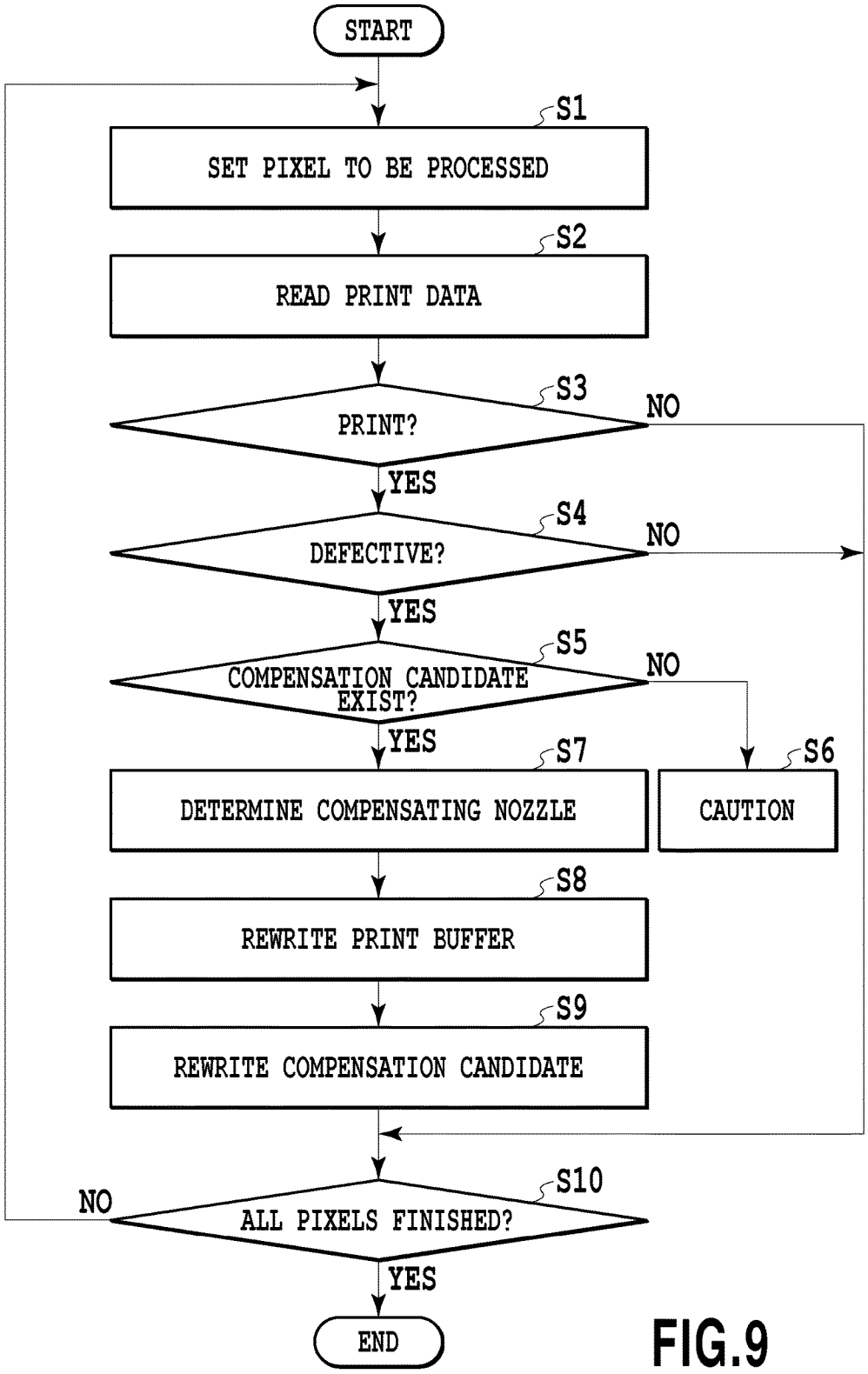
FIG. 9 is a flowchart showing a procedure of an ejection failure compensation process.

FIG. 9 is a flowchart showing a procedure of the ejection failure compensation process executed by the ejection failure compensation processing unit 208. The process is sequentially executed by the CPU 216 for each piece of print data generated by the print data generation unit 207 using various mechanisms of the ejection failure compensation processing unit 208.

If the process is started, the CPU 216 first determines a pixel to be processed in step S1. The CPU 216 reads print data corresponding to the pixel to be processed in step S2 and confirms whether the print data indicates print (1) or no print (0) in step S3. The CPU 216 proceeds to step S4 in the case of print (1) and jumps to step S10 in the case of no print (0) as the ejection failure compensation process is unnecessary for the pixel to be processed.

In step S4, the CPU 216 causes the ejection failure information reading unit 211 to read the ejection failure information from the ejection failure information buffer 205 and confirms whether a nozzle associated with the print data for the pixel to be processed is normal or defective. The CPU 216 proceeds to step S5 if the nozzle is defective and jumps to step S10 if the nozzle is not defective, that is, the nozzle is normal.

In step S5, the CPU 216 checks compensation candidates provided from the compensation candidate selection unit 212 and determines whether one or more compensation candidates exist. If no compensation candidate exists, the CPU 216 proceeds to step S6, cautions that the ejection failure compensation process cannot be executed for the pixel to be processed, and ends the process. If one or more compensation candidates exist, the CPU 216 proceeds to step S7.

In step S7, the CPU 216 reads priority information through the compensation determination unit 213 and selects a compensating nozzle from the compensation candidates provided from the compensation candidate selection unit 212. More specifically, the CPU 216 selects a nozzle having the highest priority from nozzles satisfying both a first condition that they are not defective nozzles, that is, they are normal nozzles and a second condition that they are selected as compensation candidates, and sets the selected nozzle as a compensating nozzle.

In step S8, the CPU 216 rewrites the print buffer 206 through the compensation processing unit 215. More specifically, the CPU 216 deletes print data for the pixel to be processed from a print buffer for a nozzle array allocated by the print data generation unit 207 and writes the print data in a print buffer for a nozzle array set by the compensation determination unit 213.

Further, in step S9, the CPU 216 rewrites compensation candidates through the compensation candidate selection unit 212. Since a nozzle corresponding to the print data is changed, pixels to be excluded from ejection failure compensation candidates as shown in FIG. 5A (i.e., pixels in black) are added in the compensating nozzle. Therefore, the compensation candidate selection unit 212 rewrites the compensation candidates each time the ejection failure compensation process is executed for one pixel.

In step S10, the CPU 216 determines whether the process is finished for all the pixels. If there still remains a pixel to be processed, the CPU 216 returns to step S1 and determines a pixel to be processed next. If the CPU 216 determines that the process is finished for all the pixels, the CPU 216 ends the process.

Figure 10:
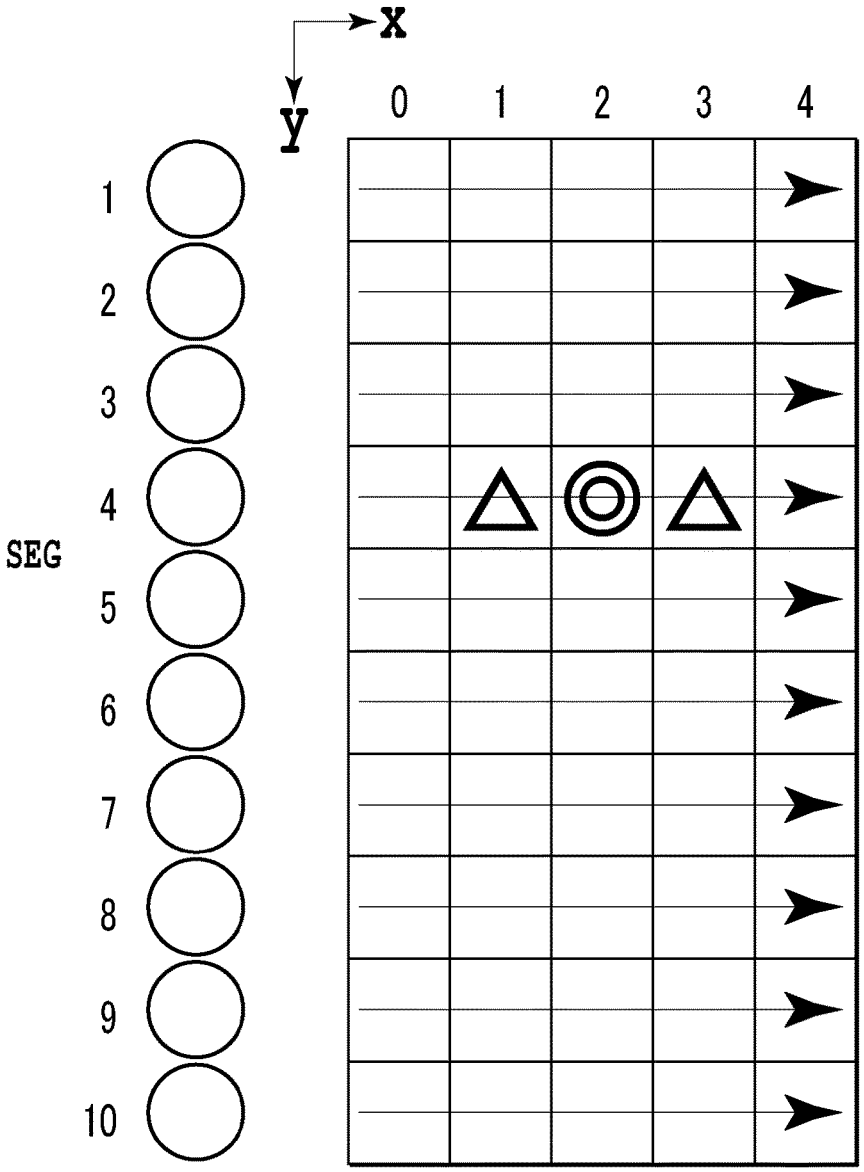
FIG. 10 is a diagram showing the order of pixels to be processed.

FIG. 10 is a diagram showing the order of pixels to be processed in the present embodiment. In the present embodiment, as described with reference to FIGS. 6A and 6B, the addition of new print data (1) affects only pixels in the ±x directions in the process of selecting compensation candidates. Therefore, it is preferable that the process is executed for the pixel positions in the x direction in the order of driving, that is, x=0, 1, 2 . . . . However, a plurality of lines (SEG) can be processed together in the y direction in which pixels do not affect each other. Accordingly, in the present embodiment, the process is executed in parallel as shown in FIG. 10 for the lines (SEG) in the y direction to reduce time required for the process. In other words, the flowchart of FIG. 9 indicates the process executed for each line (SEG) in the order of x=0, 1, 2 . . . , and is executed in parallel for the lines (SEG) and the printing heads.

According to the present embodiment described above, a nozzle corresponding to a pixel with adjacent two pixels in the x direction where ink is not ejected is used for compensation in order to secure non-ejection time of at least one pixel as refill time for all the nozzles. Therefore, no nozzle is driven for two continuous pixels even after the ejection failure compensation process and the drive rate R can be less than 0.5 (=1/(M+1), where M is a positive integer) in all the nozzles. As a result, the ejection failure compensation process can be reliably executed while maintaining stable ejection operation in all the nozzle arrays.

(Second Embodiment)

The inkjet printing apparatus described with reference to FIGS. 1A and 2 is also used in the present embodiment. However, in the printing heads of the present embodiment, refill time of the nozzles is sufficiently short (or a conveyance speed of sheets is sufficiently slow) and one nozzle can eject ink continuously to a plurality of pixels arranged in the x direction, whereas the influence of crosstalk caused by the ejection operation is larger than in the first embodiment. Therefore, the compensation candidate selection unit 212 selects nozzles not affected by crosstalk as compensation candidates as much as possible.

Figure 11:
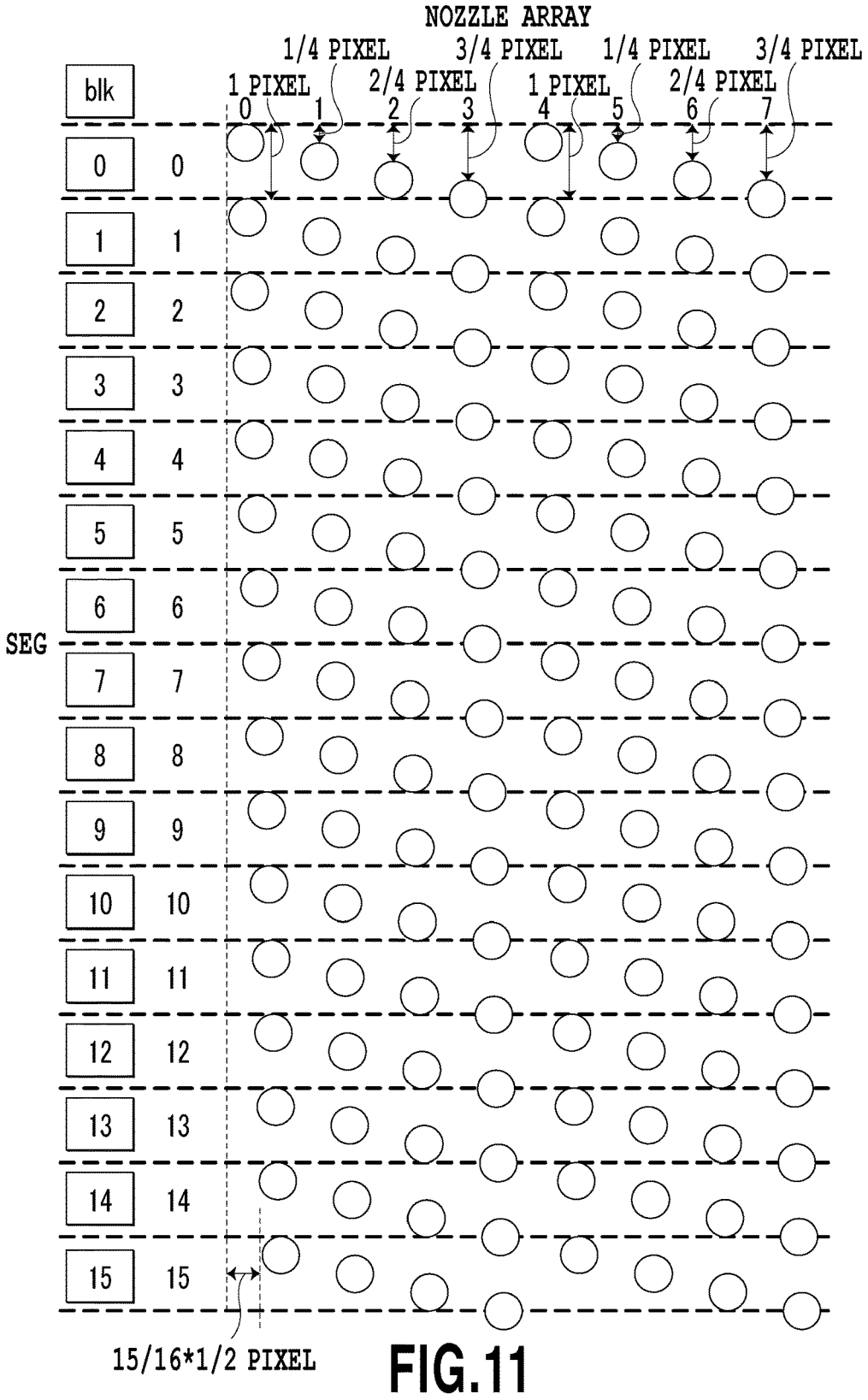
FIG. 11 is a diagram showing a state of nozzles arrayed in a printing head.

FIG. 11 is a diagram showing a state of nozzles arrayed in the printing head 105 used in the present embodiment. Each circle represents a nozzle in the same manner as FIG. 1B. In the present embodiment, the nozzle arrays 0 to 7 are arranged while being slightly shifted in the y direction. The layout of the nozzle arrays will be described below in detail.

In each of the nozzle arrays 0 to 7, nozzles are arrayed with a pitch of one pixel (600 dpi; an interval of about 42 μm) in the y direction. Based on this premise, the nozzles of the nozzle array 0 and the nozzles of the nozzle array 4 are arranged at the same positions in the y direction. The nozzle arrays 1 and 5 are located at a position shifted from the position of the nozzle arrays 0 and 4 by 1/4 pixel in the +y direction, the nozzle arrays 2 and 6 are located at a position shifted from the position of the nozzle arrays 0 and 4 by 2/4 pixel in the +y direction, and the nozzle arrays 3 and 7 are located at a position shifted from the position of the nozzle arrays 0 and 4 by 3/4 pixel in the +y direction. These nozzle arrays are used in the present embodiment to print dots at a resolution of 600 dpi in the y direction by one nozzle array, that is, at a resolution of 2400 dpi in the y direction by all the nozzle arrays.

In each nozzle array, nozzles corresponding to SEG0 to SEG15 are arrayed while being gradually shifted in the +x direction by a distance obtained by equally dividing 1/2 pixel, namely 1/32 pixel. FIG. 11 only shows the nozzles corresponding to SEG0 to SEG15, but more nozzles are actually arrayed and the layout shown by SEG0 to SEG15 is repeated in the y direction for nozzles corresponding to SEG16 onward. The printing head control unit 217 of the present embodiment executes block driving for the printing heads in which several nozzle arrays are located at the same position in the y direction and the other nozzle arrays are located at different positions in the y direction.

Figure 12:
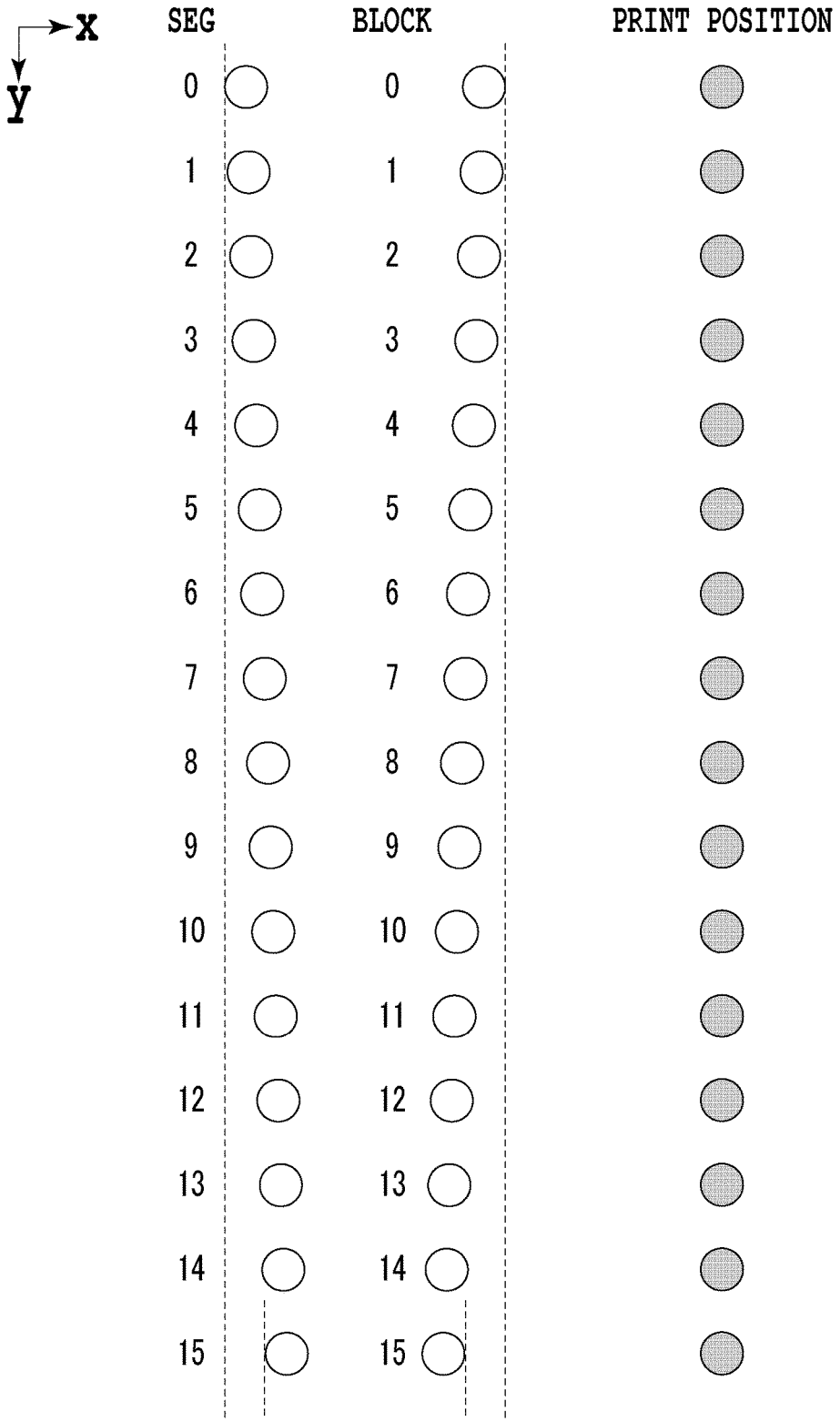
FIG. 12 is a diagram showing block driving.

FIG. 12 is a diagram showing block driving. In the present embodiment, nozzles (SEG) at the same position in the x direction are regarded as the same block and driven together, and nozzles (SEG) at the other positions are driven at different timings according to their positions. More specifically, nozzles corresponding to SEG15, SEG31, SEG47, SEG63 . . . are driven at the latest timing (blk=15). The adjacent nozzles corresponding to SEG14, SEG30, SEG46, SEG62 . . . are driven at an earlier timing (blk=14) than the latest timing (blk=15) by an amount of time corresponding to the shift in the x direction. Further, nozzles corresponding to SEG13, SEG29, SEG45, SEG61 . . . are driven at an earlier timing (blk=13) than the above timing (blk=14). Nozzles corresponding to SEG0, SEG16, SEG32, SEG48 . . . are driven at the earliest timing (blk=0). In the present embodiment, dots are printed at a resolution of 1/2 pixel (1200 dpi) in the x direction. As a result, on the sheet P, the shifts of the driving timings cancel the shifts of the nozzle positions in the x direction and all the positions of dots printed by the nozzles can be aligned in the x direction as shown in the right side of FIG. 12.

The adoption of the block driving makes it possible to disperse concurrent driving of nozzles at intervals of sixteen nozzles, thereby suppressing crosstalk. In other words, the nozzle layout shown in FIG. 11 is adopted in the present embodiment such that an image is not affected by separate driving for suppressing crosstalk.

In the block driving described above, however, a drive interval between adjacent nozzles is fairly short. If print data for the same x line exists in adjacent nozzles sharing an ink supply path, the nozzles are affected by crosstalk. For this reason, the mask data having high dispersibility as shown in FIG. 3A is adopted in the present embodiment such that driving nozzles for the same line are dispersed in the y direction. However, even in this configuration, there is a possibility that adjacent nozzles are continuously driven and suitable ejection operation cannot be performed due to crosstalk if new ejection data is added in the ejection failure compensation process. In order to avoid such a situation, the compensation candidate selection unit 212 of the present embodiment refers to print data of each nozzle array and selects candidates for a nozzle compensating for a defective nozzle such that data indicating print (1) does not continuously exist in the y direction in all the nozzle arrays.

Figure 13A:
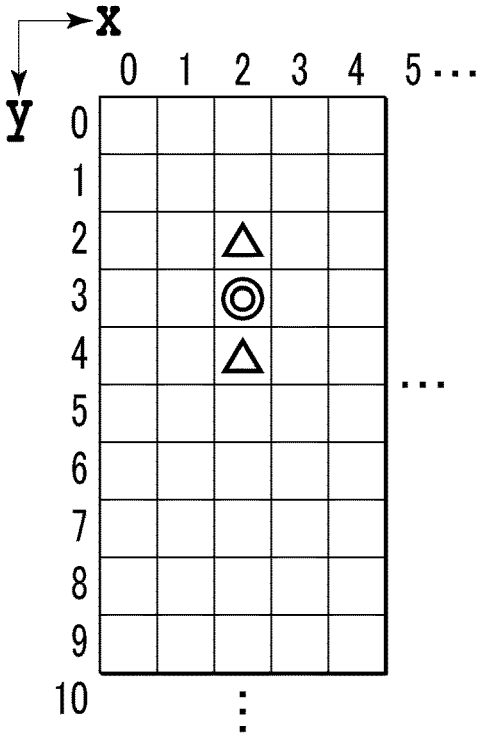
FIGS. 13A and 13B are diagrams showing conditions for excluding the influence of crosstalk.
Figure 13B:
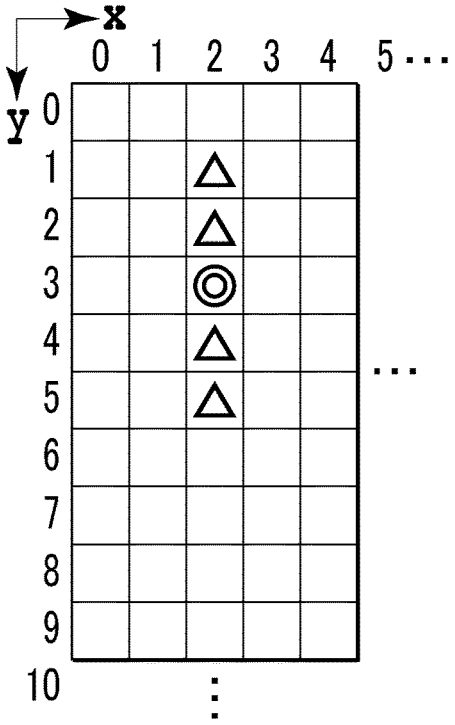

FIGS. 13A and 13B are diagrams showing conditions where the influence of crosstalk does not cause a problem. In both FIGS. 13A and 13B, the horizontal axis indicates the pixel positions in the x direction and the vertical axis indicates the nozzle positions (SEG) in the same nozzle array. FIG. 13A shows a case where nozzles are not affected by crosstalk if a distance of one nozzle is provided. In the drawings, a nozzle (SEG) determined to print a dot is represented by a double circle and nozzles (SEG) that the compensation candidate selection unit 212 excludes from ejection failure compensation candidates are represented by triangles. If a dot is to be printed by a nozzle (SEG) adjacent to the nozzle (SEG⊙) determined to print a dot, there is a possibility that the nozzle cannot normally eject ink due to crosstalk. Accordingly, in the present embodiment, the nozzle (SEG⊙) determined to print a dot and the nozzles (SEGΔ) adjacent to the nozzle (SEG⊙) in the ±y directions are excluded from ejection failure compensation candidates. Nozzles (SEG) apart from the nozzle (SEG⊙) determined to print a dot by one or more nozzles in the ±y directions are included in ejection failure compensation candidates as they are not affected by crosstalk.

FIG. 13B shows a case where nozzles are not affected by crosstalk if a distance of two nozzles is provided. In this case, a nozzle (SEG⊙) determined to print a dot and four nozzles (SEGΔ) adjacent to the nozzle (SEG⊙) in the ±y directions are excluded from ejection failure compensation candidates. Nozzles (SEG) apart from the nozzle (SEG⊙) by three or more nozzles are included in ejection failure compensation candidates. The following description is based on the premise that nozzles are not affected by crosstalk if a distance of one nozzle is provided as shown in FIG. 13A.

Figure 14B:
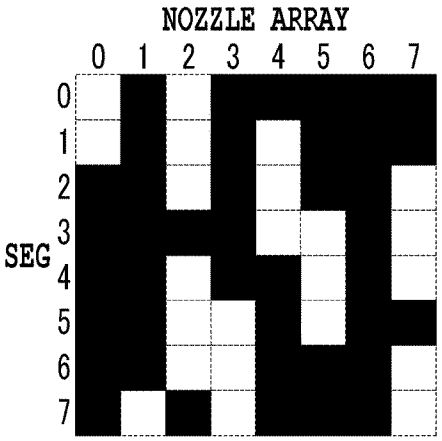
FIGS. 14A and 14B are diagrams showing a state where compensating nozzle candidates are selected.
Figure 14A:
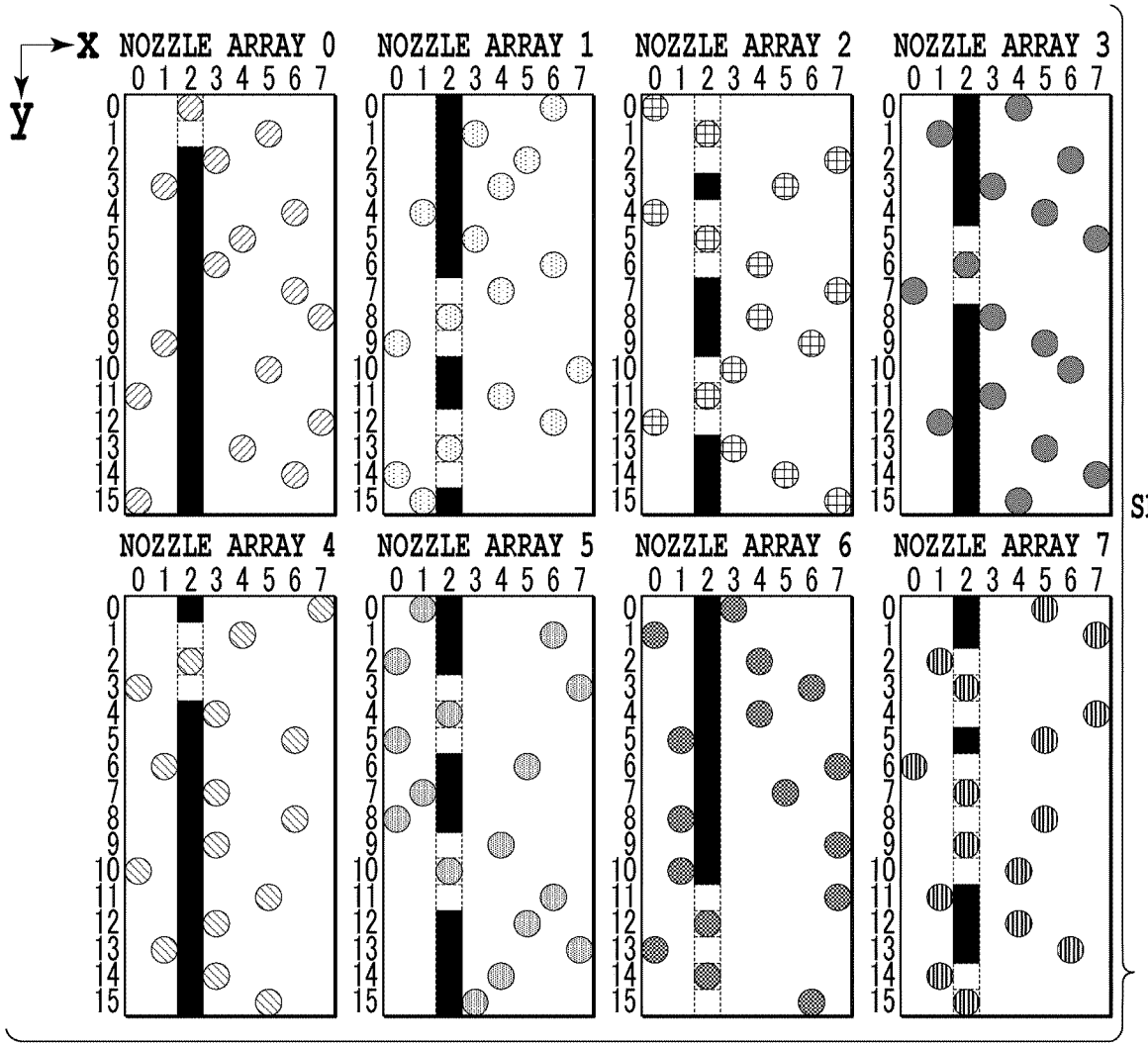

FIG. 14A is a diagram showing a state where the compensation candidate selection unit 212 of the present embodiment selects compensating nozzle candidates for each nozzle array. FIG. 14A shows the selection of compensating nozzle candidates only for the line of x=2. In either nozzle (SEG), a nozzle determined to print a dot and nozzles adjacent to the nozzle are not selected as ejection failure compensation candidates. The other nozzles are selected as ejection failure compensation candidates. In FIG. 14A, pixel positions (SEG) selected as candidates are represented by solid black squares.

FIG. 14B is a diagram showing the resultant compensation candidates for the line of x=2 shown in FIG. 14A, arranged according to the nozzle arrays 0 to 7. In FIG. 14B, the horizontal axis indicates the nozzle array numbers, the vertical axis indicates the SEG numbers (y), nozzles (SEG) in black indicate nozzles (SEG) selected as ejection failure compensation candidates, and nozzles (SEG) in white indicate nozzles (SEG) excluded from the candidates. The compensation candidate selection unit 212 of the present embodiment generates such information on the candidates for an ejection failure compensating nozzle and provides the information to the compensation determination unit 213.

Incidentally, the ejection failure compensation process can be executed in accordance with the flowchart of FIG. 9 in the present embodiment like the first embodiment. However, in the case of the present embodiment, the rewrite of compensation candidates in step S9 has an influence in the direction of nozzle arrays, or the y direction. Accordingly, in the execution of the flowchart of FIG. 9, the order of pixels to be processed in the y direction should be considered.

Figure 15A:
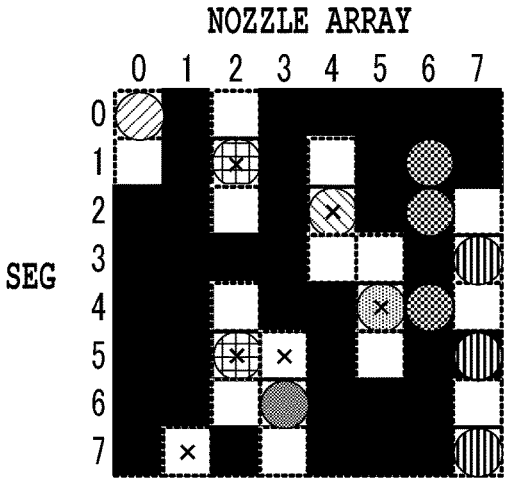
FIGS. 15A and 15B are diagrams showing a state where a compensating nozzle is determined.
Figure 15B:
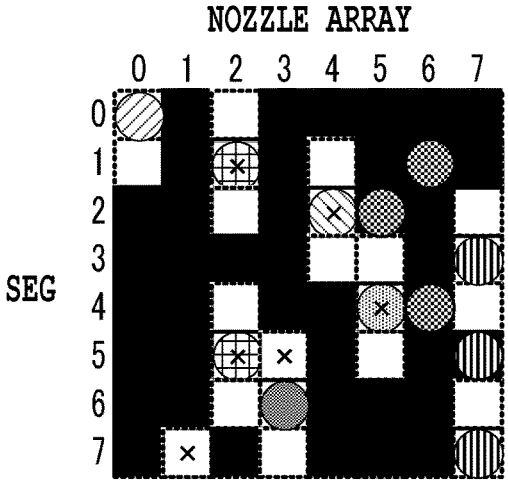

FIGS. 15A and 15B are diagrams showing a state where the compensation determination unit 213 of the present embodiment determines a compensating nozzle like FIG. 8. The mask data, the ejection failure information, and the priority information are the same as those in the first embodiment. FIGS. 15A and 15B show the results of making the order of pixels to be processed different. FIG. 15A shows a case where a plurality of lines (SEG) in the y direction are processed together as shown in FIG. 10. FIG. 15B shows a case where the ejection failure compensation process is sequentially executed for pixels (SEG) arrayed in the y direction as shown in FIG. 16.

In the case of processing the lines (SEG) together, the process is independent in each line (SEG) and therefore information about a compensating nozzle determined in a line (SEG) cannot be reflected on the other lines (SEG). As a result, adjacent two nozzles (SEG) may be set as compensating nozzles like the nozzle array 6 in FIG. 15A. This may result in the risk of crosstalk.

Figure 16:
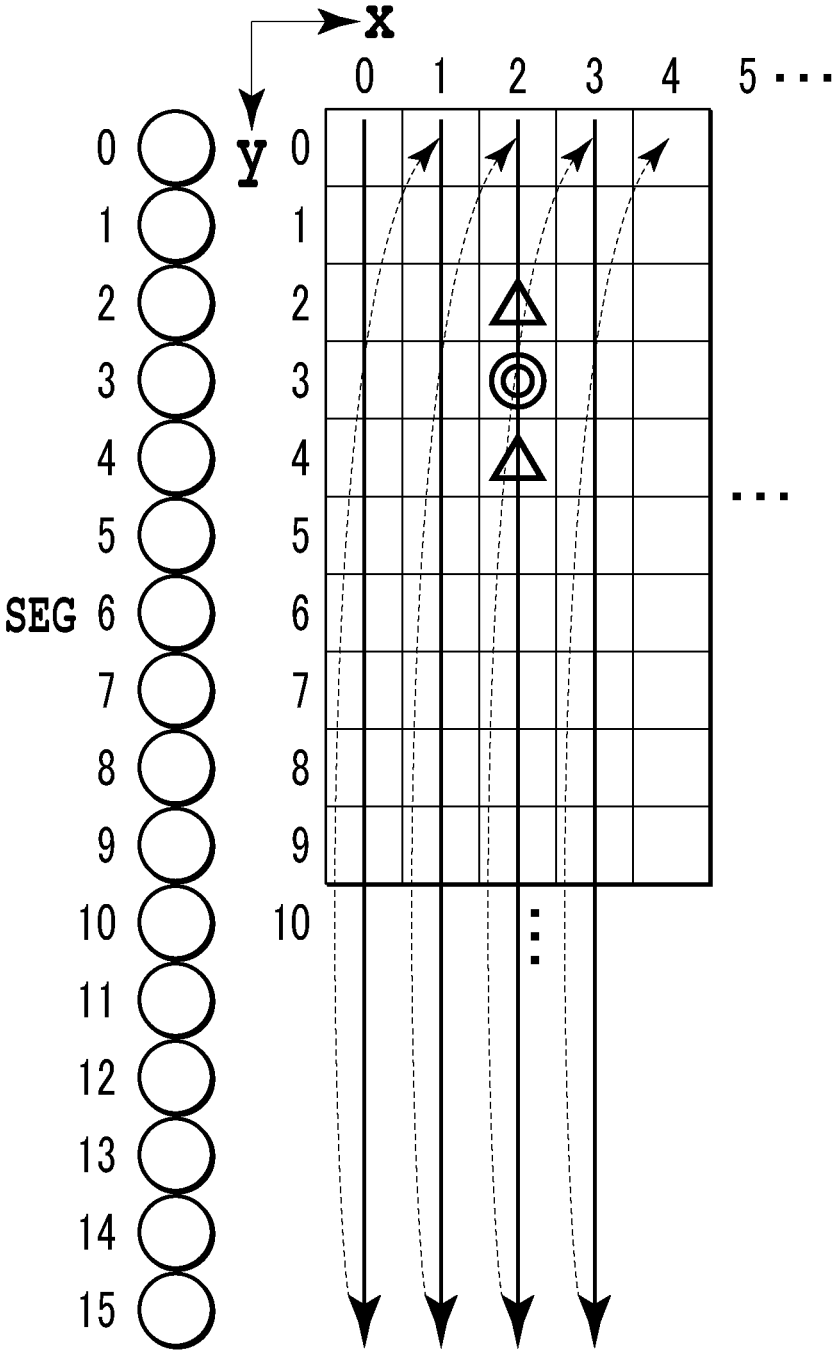
FIG. 16 is a diagram showing the order of pixels to be processed.

In contrast, in the case of sequentially executing the ejection failure compensation process for the pixels (SEG) in the +y direction as shown in FIG. 16, information about a compensating nozzle (SEG) newly determined in the ejection failure compensation process can be reflected on an adjacent line (SEG) in the +y direction. As a result, a situation where adjacent two nozzles (SEG) in the y direction are set as compensating nozzles can be avoided and print data in which nozzles are dispersed in the y direction as shown in FIG. 15B can be generated.

However, if the target of the process is changed to pixels in the next x line after the completion of the process for all the pixels (SEG) in the y direction as shown in FIG. 16, the processing speed may be reduced. To avoid this problem, in the present embodiment, pixels (SEG) may be divided into groups so as to execute a parallel process in each group and a serial process for the groups.

Figure 17A:
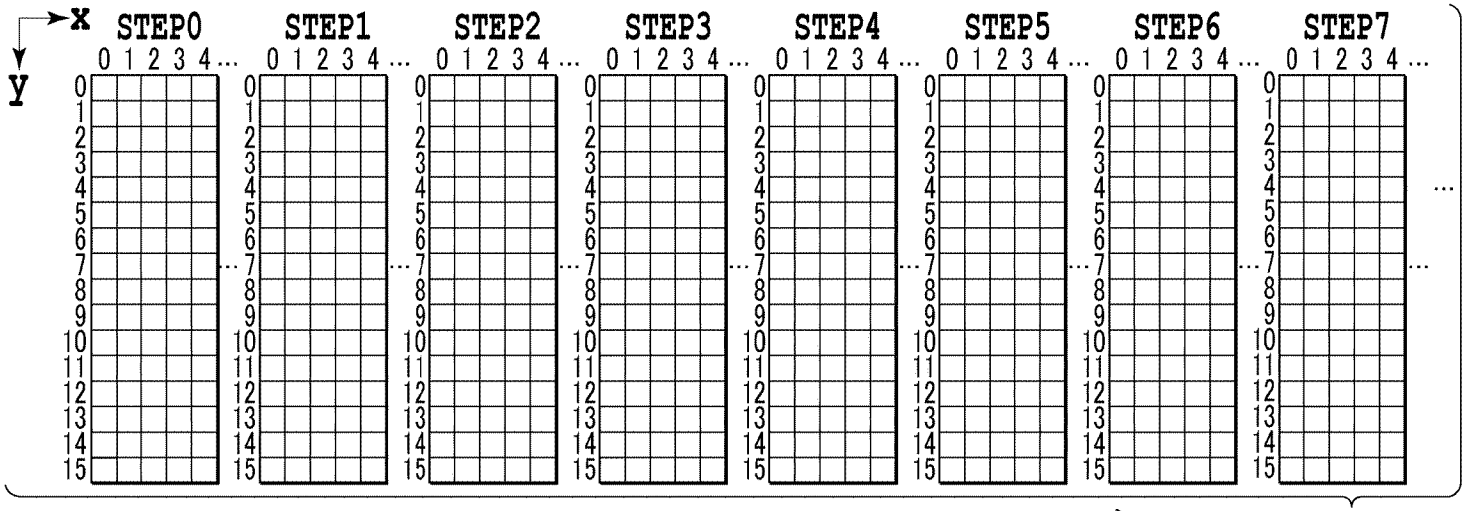
FIGS. 17A and 17B are diagrams showing the processing order in the case of grouping.
Figure 17B:
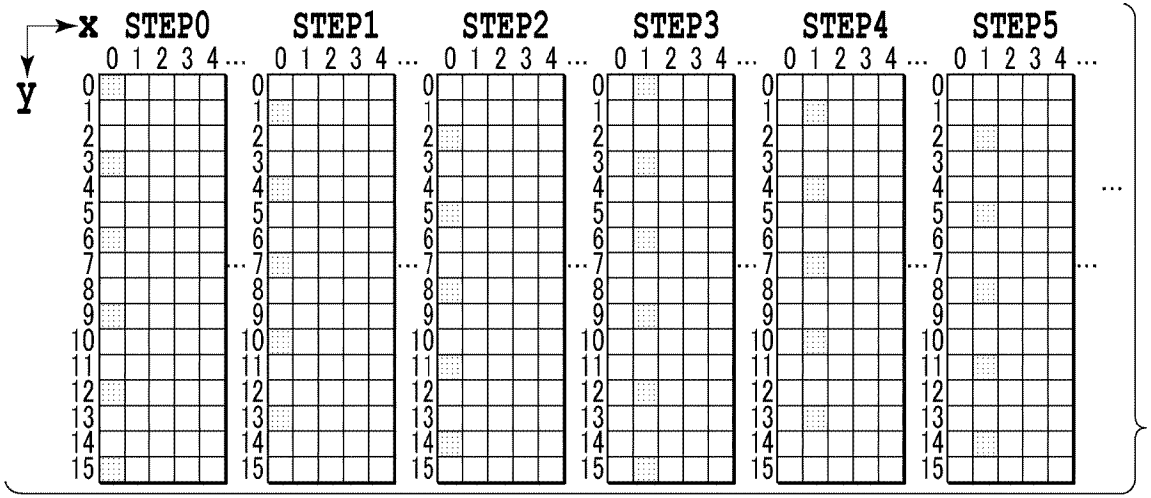

FIGS. 17A and 17B are diagrams showing the processing order in the case of grouping. FIG. 17A shows a case where a group consists of four alternate pixels (SEG). FIG. 17B shows a case where a group consists of every third pixel (SEG) in a line. The grouping of FIG. 17A is suitable for a case where crosstalk can be suppressed by a distance of one nozzle as shown in FIG. 13A. The grouping of FIG. 17B is suitable for a case where crosstalk can be suppressed by a distance of two nozzles as shown in FIG. 13B.

In either case, the ejection failure compensation process is executed together for pixels (SEG) in the same group. Since the pixels are located at positions not affected by crosstalk, the problem shown in FIG. 15A does not occur even if nozzles corresponding to the pixels are set as compensating nozzles together. The two examples are described, but the grouping is not limited to these examples. For instance, a group may consist of every other pixel (SEG) in a line or every fourth or more pixel (SEG).

Figure 18:
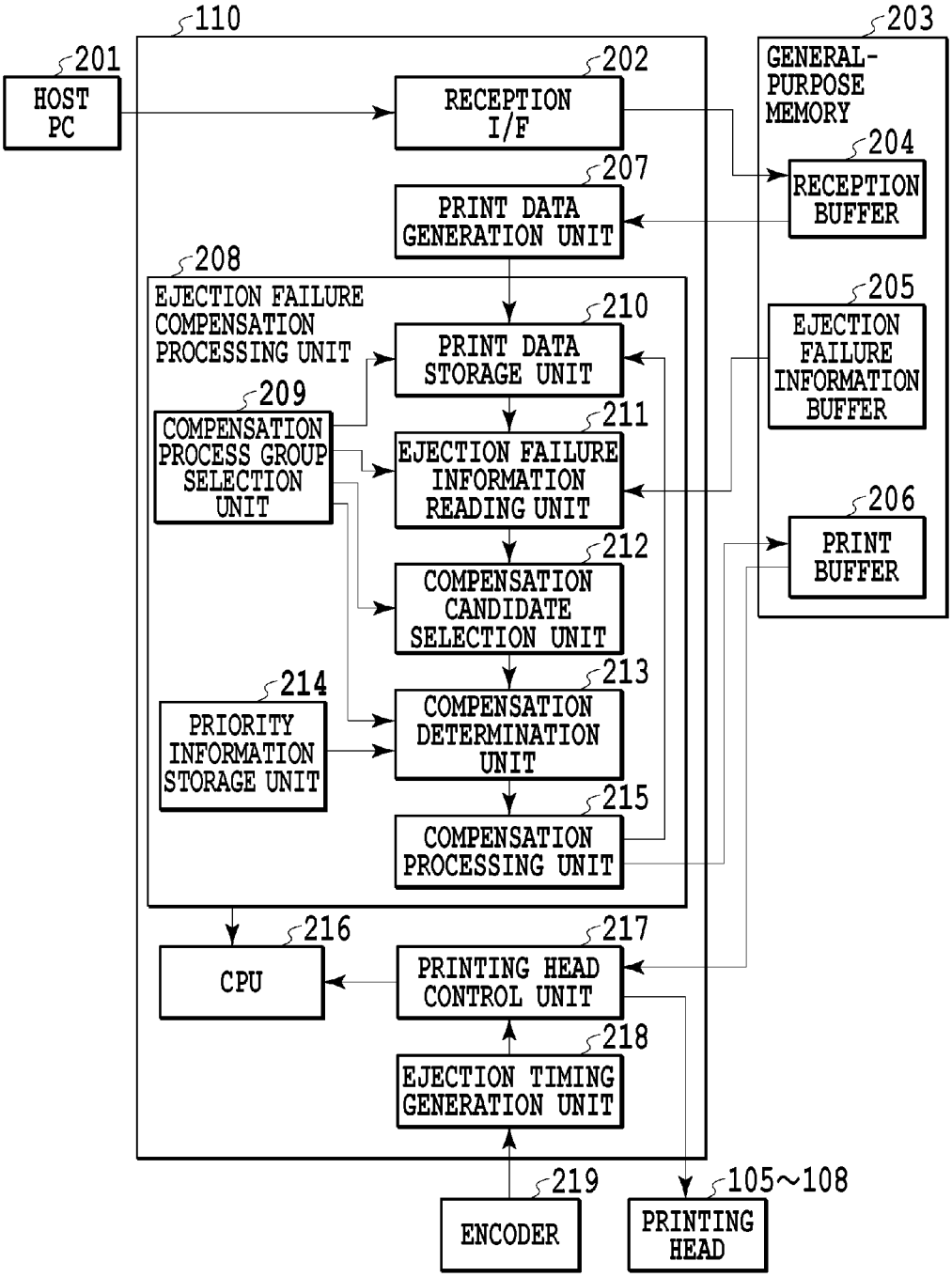
FIG. 18 is a block diagram showing the control configuration in the case of adopting the grouping.

FIG. 18 is a block diagram showing the control configuration in the case of adopting the grouping. FIG. 18 is different from FIG. 2 in that a compensation process group selection unit 209 is added. The compensation process group selection unit 209 manages pixels (SEG) for which the ejection failure compensation process is executed in parallel as a group, selects a corresponding group and controls the ejection failure compensation process in a group according to print data to be processed.

Figure 19:
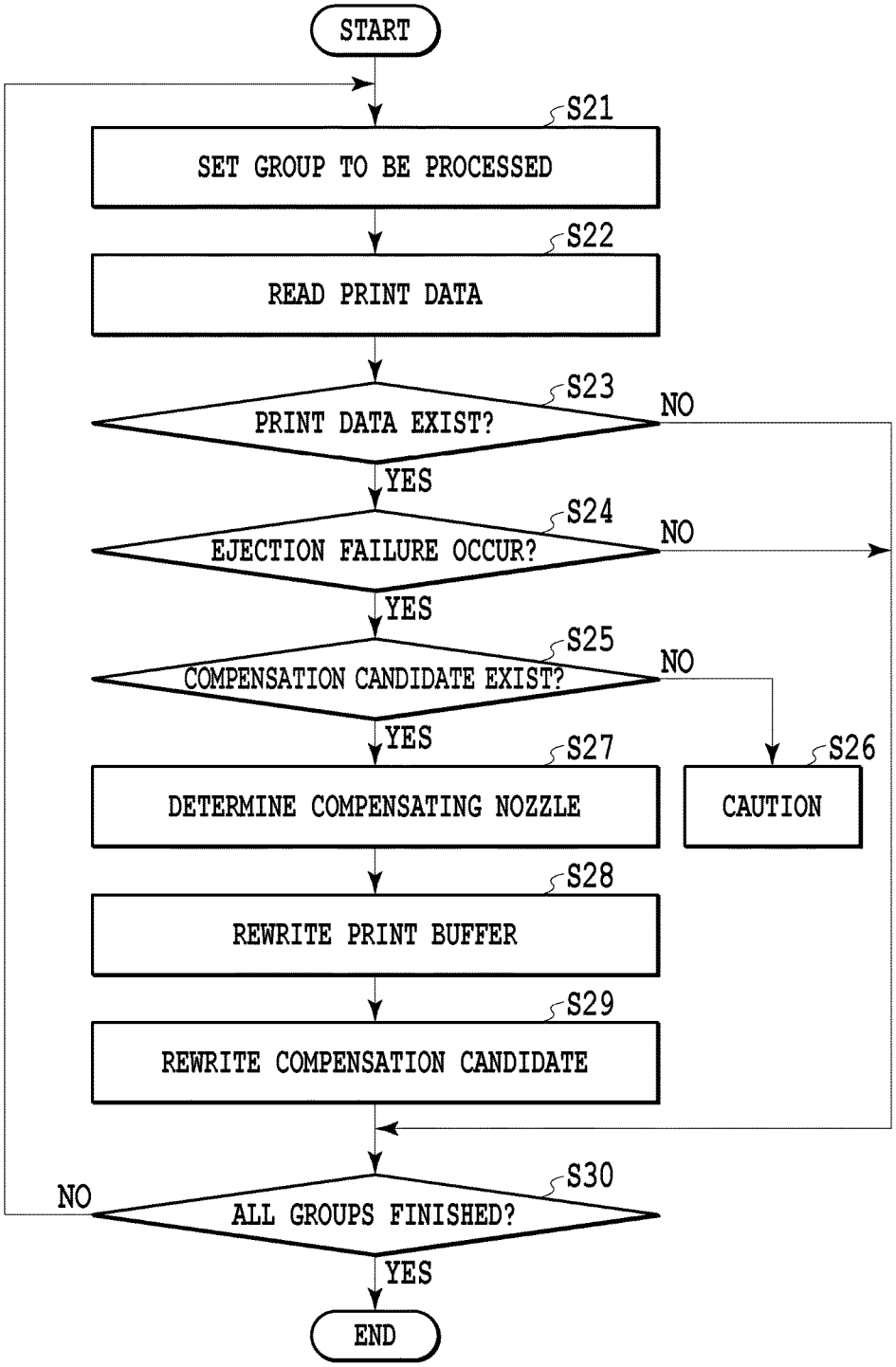
FIG. 19 is a flowchart showing a procedure of the ejection failure compensation process in the case of adopting the grouping.

FIG. 19 is a flowchart showing a procedure of the ejection failure compensation process in the case of adopting the grouping. In FIG. 9, a piece of print data for a pixel to be processed is read and the ejection failure compensation process is executed for each pixel. In contrast, in FIG. 19, the process is executed for each group. To be more specific, the CPU 216 determines a group to be processed in step S21 and reads pieces of print data for all pixels (SEG) included in the determined group in step S22.

If the CPU 216 determines that there is data indicating print (1) in step S23, the CPU 216 proceeds to step S24 and reads ejection failure information corresponding to the group to be processed through the ejection failure information reading unit 211. Then, the CPU 216 confirms whether nozzles associated with the print data are normal or defective.

If there is print data corresponding to a defective nozzle (SEG), the CPU 216 proceeds to step S25, confirms compensation candidates provided from the compensation candidate selection unit 212, and determines whether one or more compensation candidates exist for each piece of print data. If compensation candidates exist for all the pieces of print data, the CPU 216 proceeds to step S27, reads the priority information through the compensation determination unit 213, and selects a compensating nozzle from the compensation candidates provided from the compensation candidate selection unit 212 for each piece of print data (SEG). More specifically, the CPU 216 selects a nozzle having the highest priority from nozzles satisfying both a first condition that they are not defective nozzles, that is, they are normal nozzles and a second condition that they are selected as compensation candidates, and sets the selected nozzle as a compensating nozzle.

Further, the CPU 216 rewrites the print buffer 206 through the compensation processing unit 215 in step S28 and rewrites the compensation candidates through the compensation candidate selection unit 212 in step S29. At this time, the compensation candidate selection unit 212 rewrites compensation candidate information for pixels (SEG) included in groups different from the group to be processed.

In step S30, the CPU 216 determines whether the process is finished for all the groups. If there still remains a group to be processed, the CPU 216 returns to step S21 and determines a group to be processed next. If the CPU 216 determines that the process is finished for all the groups, the CPU 216 ends the process.

Figure 20:
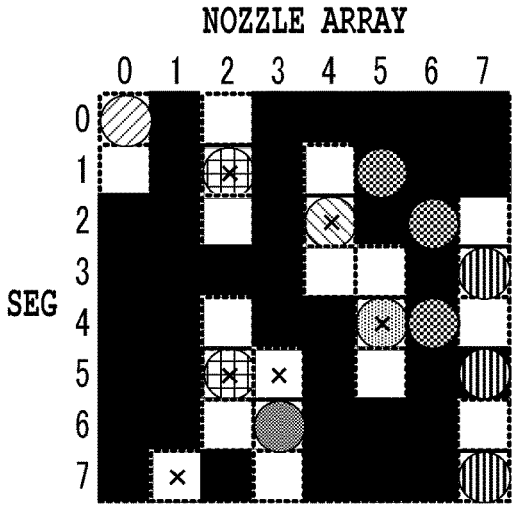
FIG. 20 is a diagram showing a state where a compensating nozzle is determined in the case of adopting the grouping.

FIG. 20 is a diagram showing a state where the compensation determination unit 213 determines a compensating nozzle in the case of adopting the grouping in the same manner as FIG. 8. Like FIG. 15B, adjacent two nozzles (SEG) are not set as compensating nozzles and print data is dispersed in the y direction even after the ejection failure compensation process.

If the ejection failure compensation process is executed for each group as described above, the number of compensation candidates in a group to be subsequently processed decreases according to a result of a process for a group to be previously processed. Accordingly, the number of compensation candidates and the number of driven nozzles may be different between groups depending on whether each group is processed previously or subsequently. If such a difference causes a problem, the difference may be reduced by switching between a SEG group to be previously processed and a SEG group to be subsequently processed, for example, per page.

According to the present embodiment described above, a compensating nozzle in the ejection failure compensation process is determined such that adjacent nozzles included in the same nozzle array do not eject ink in the same line. A nozzle corresponding to a pixel with adjacent two pixels in the y direction where ink is not ejected is used for compensation in order to avoid a situation where adjacent two nozzles are driven at substantially the same time even after the ejection failure compensation process. Therefore, the drive rate R in the same nozzle array can be less than 0.5 (=1/(N+1), where N is a positive integer) in all the lines. As a result, the ejection failure compensation process can be reliably executed while maintaining stable ejection operation in all the nozzle arrays 0 to 7.

(Third Embodiment)

The inkjet printing apparatus described with reference to FIGS. 1A and 2 is also used in the present embodiment. Further, the printing head including the arrays shown in FIG. 11 is used and the block driving shown in FIG. 12 is adopted. Further, in the same manner as the first embodiment, the block diagram shown in FIG. 2 is adopted and the predetermined ejection failure compensation process is executed for each pixel in the order shown in FIG. 16 in accordance with the flowchart of FIG. 9. In the present embodiment, a description will be provided for a case of executing the ejection failure compensation process while applying limitations regarding both refill time and crosstalk in the x and y directions.

Figures 21A, 21B, 21C, 21D:
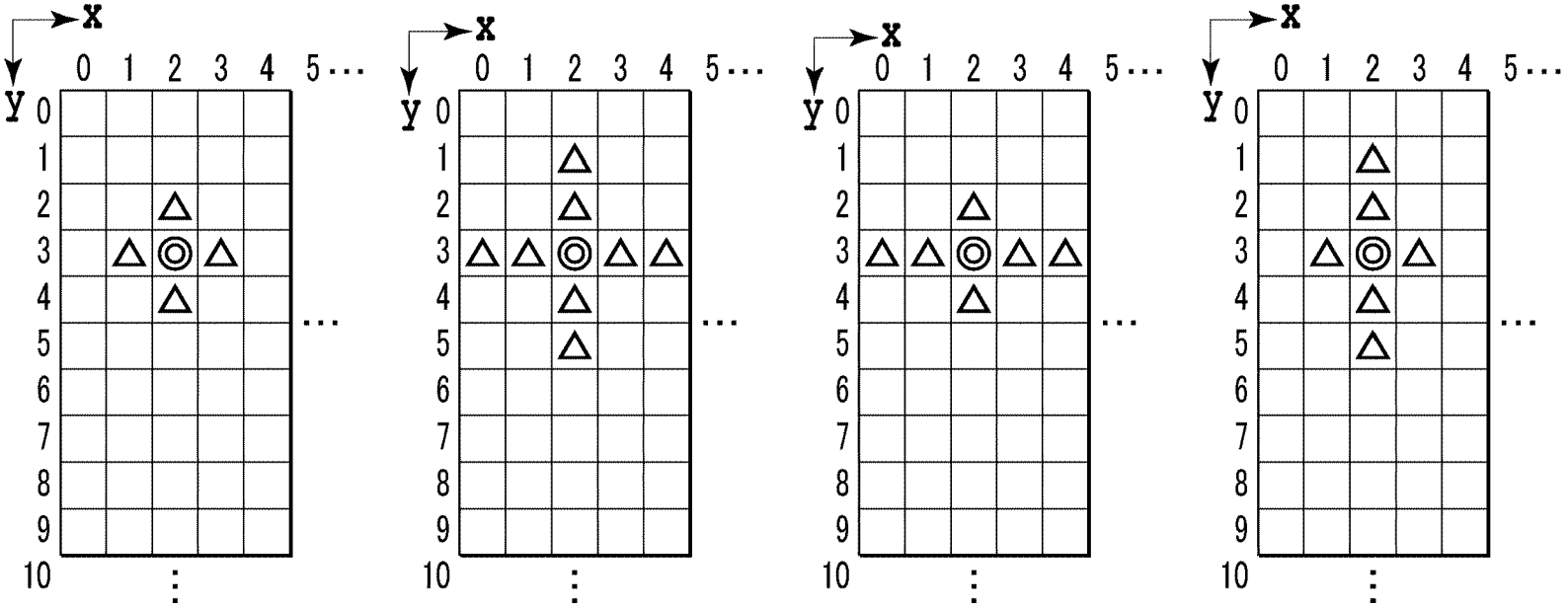
FIGS. 21A to 21D are diagrams showing conditions for a normal ejection state.

FIGS. 21A to 21D are diagrams showing conditions for securing sufficient refill time and excluding the influence of crosstalk. In the same manner as FIGS. 5A, 5B, 13A and 13B, the horizontal axis indicates the pixel positions in the x direction and the vertical axis indicates the nozzle positions (SEG) in the same nozzle array. FIG. 21A shows a case where nozzles can be refilled within non-ejection time of one pixel and are not affected by crosstalk if a distance of one nozzle is provided. FIG. 21B shows a case where nozzles can be refilled within non-ejection time of two pixels and are not affected by crosstalk if a distance of two nozzles is provided. FIG. 21C shows a case where nozzles can be refilled within non-ejection time of two pixels and are not affected by crosstalk if a distance of one nozzle is provided. FIG. 21D shows a case where nozzles can be refilled within non-ejection time of one pixel and are not affected by crosstalk if a distance of two nozzles is provided. The following description is based on the premise that non-ejection time of one pixel is necessary for stable refilling and a distance of one nozzle is necessary for reducing the influence of crosstalk as shown in FIG. 21A.

Figure 22B:
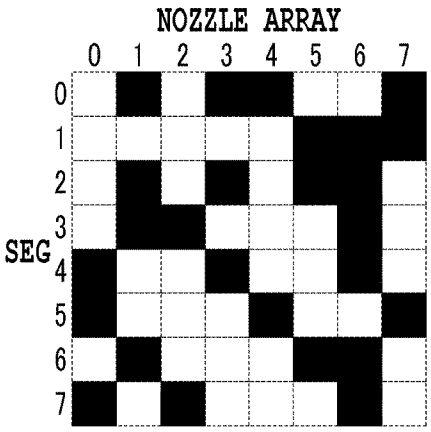
FIGS. 22A and 22B are diagrams showing a state where compensating nozzle candidates are selected.
Figure 22A:
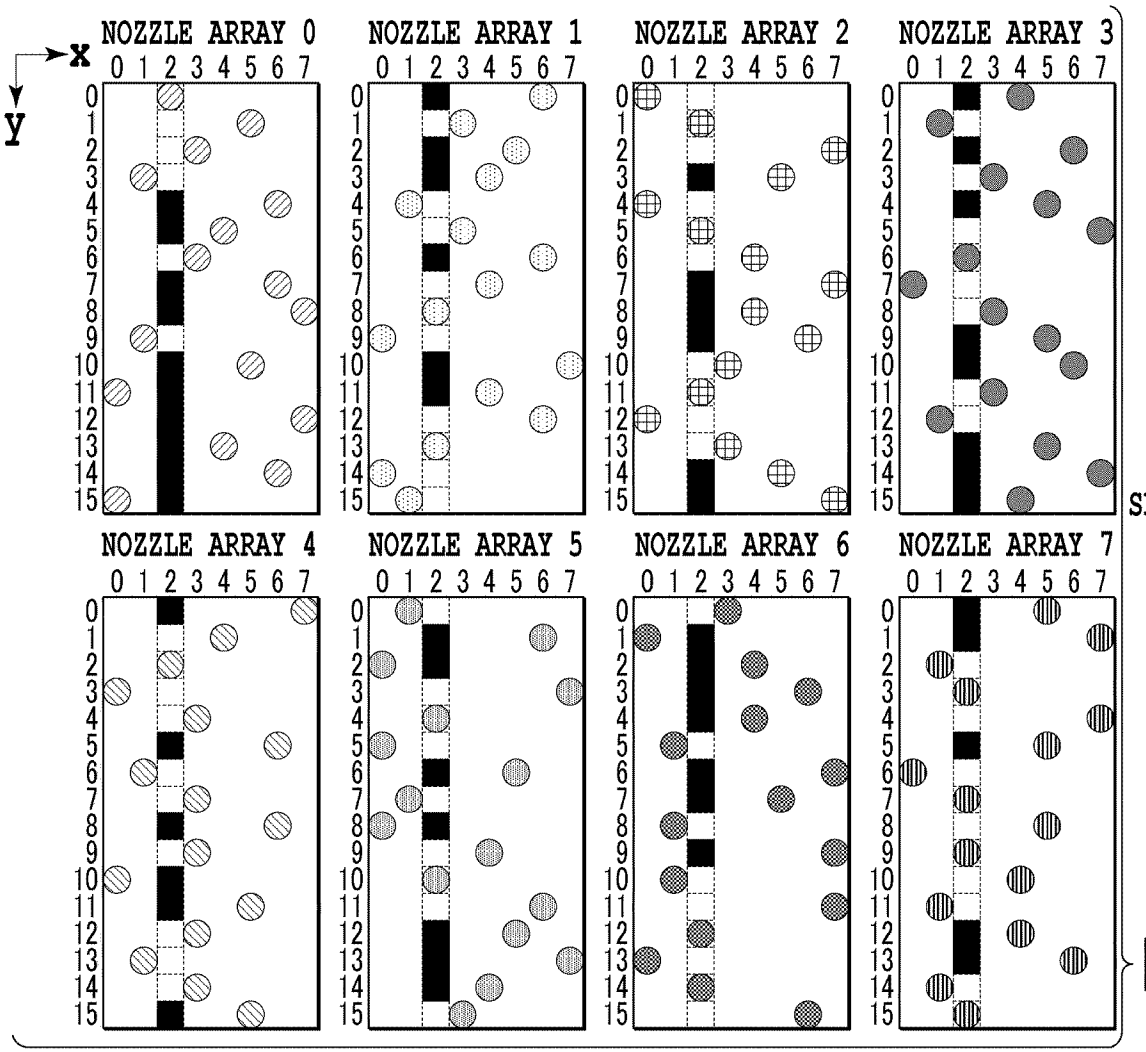

FIG. 22A is a diagram showing a state where the compensation candidate selection unit 212 of the present embodiment selects compensating nozzle candidates for each nozzle array. FIG. 22B is a diagram showing the resultant candidates for the line of x=2 shown in FIG. 22A, arranged according to the nozzle arrays 0 to 7. FIG. 22A shows that pixels ○ at which dots are determined to be printed, adjacent pixels in the ±x directions, and adjacent pixels (SEG) in the ±y directions are not selected as ejection failure compensation candidates in either nozzle array.

Figure 23:
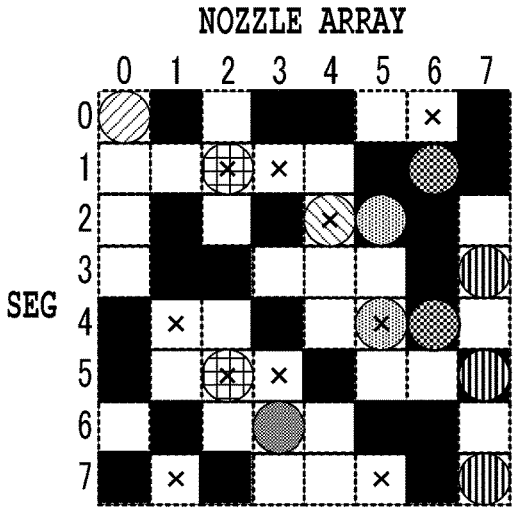
FIG. 23 is a diagram showing a state where a compensating nozzle is determined.

FIG. 23 is a diagram showing a state where the compensation determination unit 213 of the present embodiment determines a compensating nozzle in the same manner as FIG. 8. The mask data, the ejection failure information, and the priority information are the same as those in the first embodiment. Adjacent nozzles (SEG) are not driven in the same line in the nozzle array. Further, one nozzle is not driven for continuous pixels. As a result, the drive rate R can be less than 0.5 in both the x direction and the y direction. The ejection failure compensation process can be reliably executed while maintaining the stable ejection operation in all the nozzle arrays 0 to 7.

It should be noted that the block diagram of FIG. 18 and the flowchart of FIG. 19 can be adopted to perform the grouping control for improving the processing speed in the present embodiment like the second embodiment. In this case, in step S29, the compensation candidate selection unit 212 excludes pixels (SEG) adjacent to print data, which is newly added for ejection failure compensation, in the x direction and the y direction from the ejection failure compensation candidates.

(Fourth Embodiment)

In the case of the nozzle arrays shown in FIG. 11, positions at which dots are printed by each nozzle array are gradually shifted in the y direction within one pixel (SEG). Accordingly, a position at which a dot is actually printed by a compensating nozzle may be deviated from a position at which a dot should be printed by a detective nozzle, and the deviation may be conspicuous. For example, in a case where an ejection failure occurs in a nozzle in the nozzle array 0, a dot can be printed at the same position in the y direction if a compensating nozzle is in the nozzle array 4. However, if a compensating nozzle is in any of the nozzle arrays 1 to 3 and 5 to 7, a deviation occurs within one pixel of 600 dpi. Further, the deviation increases in the order of the nozzle array 4, the nozzle arrays 1 and 5, the nozzle arrays 2 and 6, and the nozzle arrays 3 and 7. In other words, in the case where the compensation process becomes more conspicuous as the deviation increases, priorities of nozzle arrays suitable for compensation are different in each nozzle array. In consideration of the situation, in the present embodiment, the priority information storage unit 214 stores pieces of priority information associated with the nozzle arrays, respectively.

Figure 24:
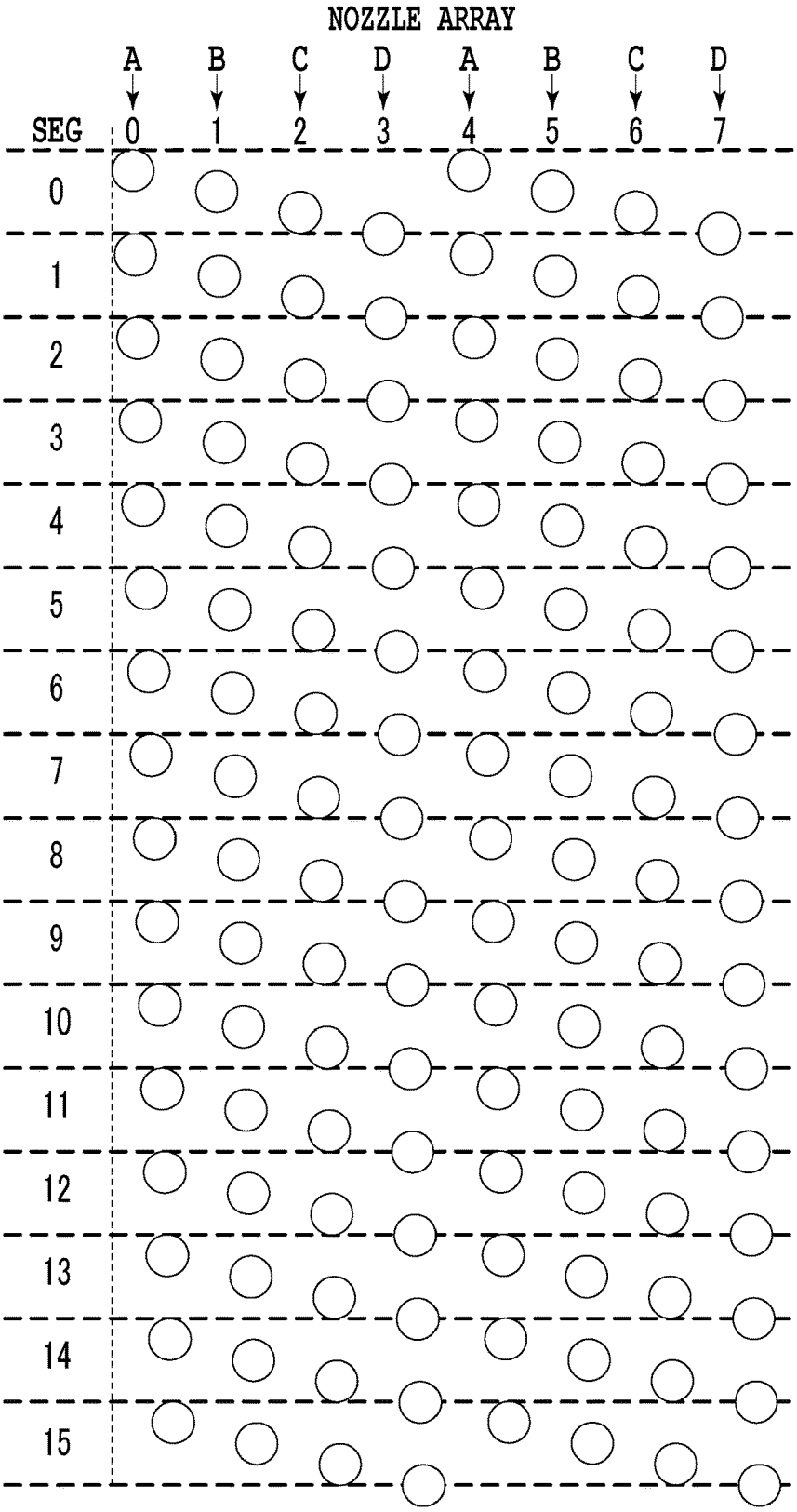
FIG. 24 is a diagram showing the classification of nozzle arrays.

FIG. 24 is a diagram showing the classification of the nozzle arrays 0 to 7. The nozzle arrays 0 to 7 are classified as follows: the nozzle arrays 0 and 4 are of A class, the nozzle arrays 1 and 5 are of B class, the nozzle arrays 2 and 6 are of C class, and the nozzle arrays 3 and 7 are of D class. In either class, nozzle arrays in the same class can print dots at the same positions in the y direction and are suitable for compensation for each other. B class is the second most suitable for compensation for A class, followed by C class and D class. Therefore, priority information in which priorities are set in the order of A class, B class, C class, and D class is prepared for the nozzle arrays of A class. In the same manner, priority information in which priorities are set in a suitable order is prepared for each of B, C, and D classes.

FIG. 25 is a diagram showing priority information for each class. In either class, nozzle arrays included in its own class have the highest priority and the priority becomes lower as a distance to a nozzle array becomes longer.

Figure 26A:
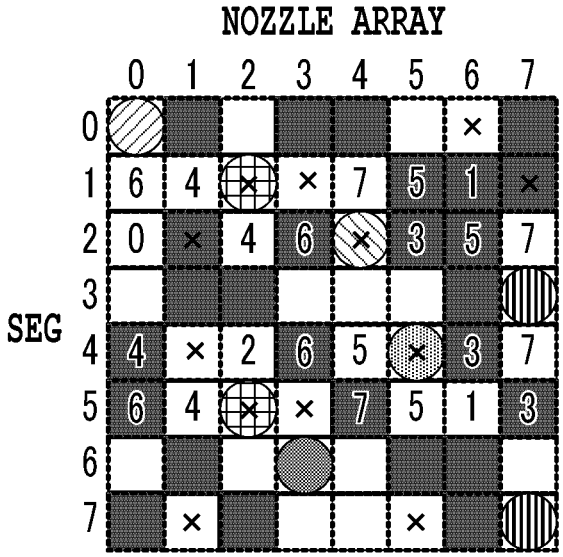
FIGS. 26A and 26B are diagrams showing a state where a compensating nozzle is determined.
Figure 26B:
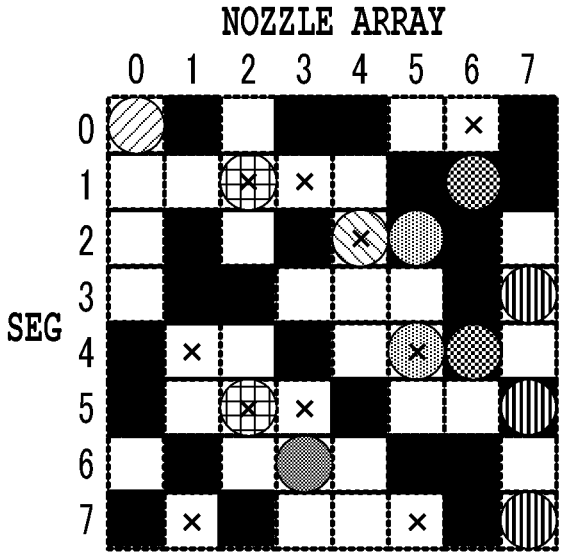

FIGS. 26A and 26B are diagrams showing a state where the compensation determination unit 213 of the present embodiment determines a compensating nozzle. The mask data, the ejection failure information, and the selection of compensation candidates are the same as those in the third embodiment. However, priority information is unique to each nozzle array as shown in FIG. 25. On the same condition as the third embodiment, FIG. 26A shows the compensation candidate information (black/white) for a line of x=2, the nozzle information (x) shown in FIG. 4, and the priorities (numbers) of the nozzle arrays, overlapping each other. FIG. 26B shows a result of determination of a compensating nozzle.

For example, the print data generation unit 207 allocates print data of x=2 to a nozzle at SEG1 of the nozzle array 2, but the nozzle is defective (x). Therefore, the compensation determination unit 213 refers to a line of x=2 in the priority information for C class shown in FIG. 25. The nozzle array 2 has the highest priority (priority 0) in the line of x=2, but the corresponding nozzle is defective (x). The compensation determination unit 213 confirms whether a nozzle of the nozzle array 6 having the second highest priority (priority 1) is a normal nozzle and whether the nozzle is selected as a compensation candidate in the line of x=2. In this example, a nozzle at SEG1 of the nozzle array 6 is normal and is selected as a compensation candidate (solid) in the line of x=2. Therefore, the compensation determination unit 213 sets the nozzle at SEG1 of the nozzle array 6 as a compensating nozzle for the defective nozzle (SEG1) of the nozzle array 2 in the line of x=2. The same process is executed for other defective nozzles.

According to the present embodiment described above, a nozzle with a minimum shift from a defective nozzle in the y direction can be used for a compensation process for the defective nozzle with the higher priority. As a result, the ejection failure compensation process can be executed in a preferable state such that the existence of the defective nozzle is inconspicuous in an image.

It should be noted that the priority information does not necessarily indicate all the nozzle arrays as candidates. For example, a nozzle array shifted from a defective nozzle in the same SEG may be excluded from compensation candidates.

FIGS. 27 to 29 are diagrams showing other examples of the priority information. FIG. 27 shows priority information in the case where nozzle arrays shifted from a defective nozzle by 3/4 pixel are excluded from compensation candidates. In the priority information for A class (nozzle arrays 0 and 4), the nozzle arrays of D class (nozzle arrays 3 and 7) are not stored, that is, excluded from compensation candidates. Since no nozzle array is shifted from the nozzle arrays of B class (nozzle arrays 1 and 5) and C class (nozzle arrays 2 and 6) in the same SEG by 3/4 pixel, all the nozzle arrays are stored as compensation candidates in the priority information. In the priority information for D class (nozzle arrays 3 and 7), the nozzle arrays of A class (nozzle arrays 0 and 4) shifted by 3/4 pixel are not stored, that is, excluded from compensation candidates.

In a similar way, FIG. 28 shows priority information in a case where nozzle arrays shifted from a defective nozzle by 2/4 pixel or more are excluded from compensation candidates. FIG. 29 shows priority information in a case where nozzle arrays shifted from a defective nozzle by 1/4 pixel or more are excluded from compensation candidates, that is, in a case where only nozzle arrays of the same class are selected as compensation candidates. It is possible to determine which of the types of information shown in FIGS. 25 and 27 to 29 should be used as priority information based on an image as a result of the ejection failure compensation process. For example, it is possible to determine which of the types shown in FIGS. 25 and 27 to 29 should be used according to ink colors.

Figure 30:
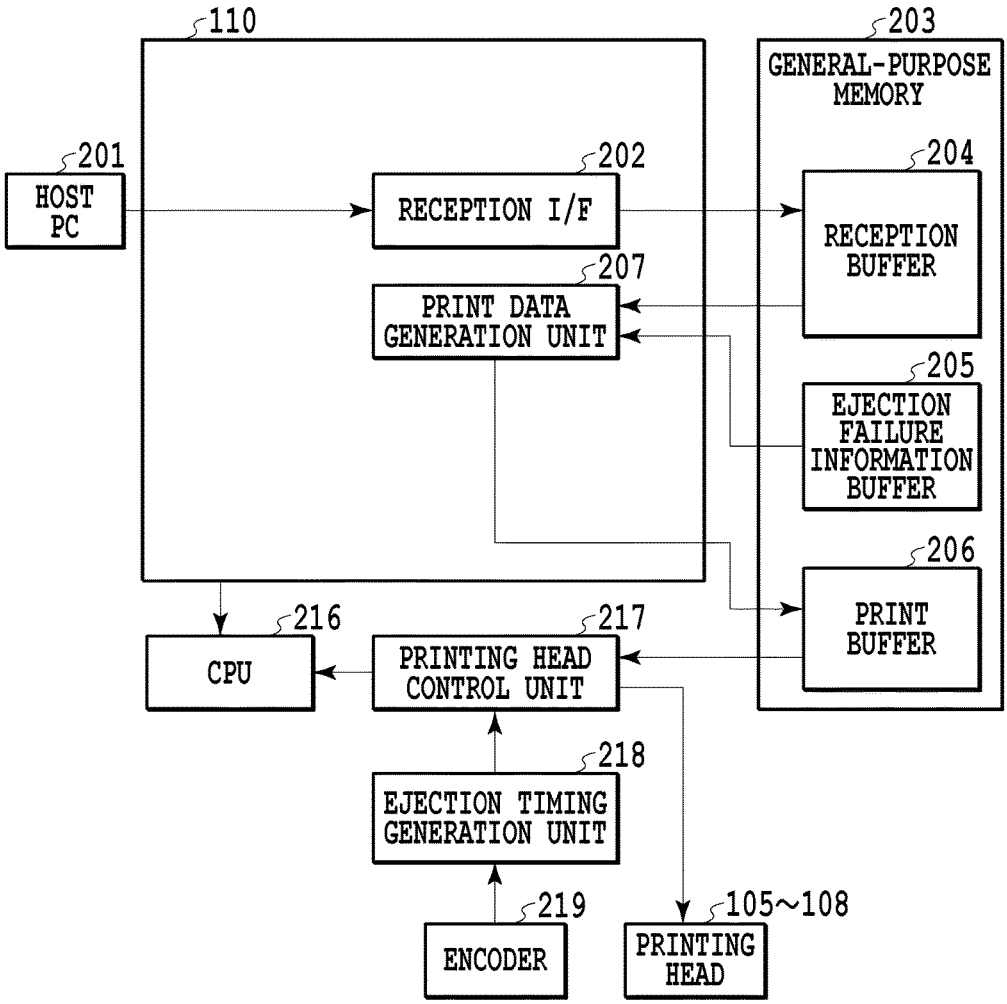
FIG. 30 is a block diagram showing another example of the control configuration.

In the first to fourth embodiments described above, the case where the ejection failure compensation processing unit 208 corrects the print data generated by the print data generation unit 207 is described with reference to FIG. 2. However, the present invention is not limited to this case. For example, as shown in FIG. 30, the print data generation unit 207 may allocate print data stored in the reception buffer to the nozzle arrays 0 to 7 with reference to both the mask data shown in FIG. 3A and the ejection failure information stored in the ejection failure information buffer 205.

In the embodiments described above, the full-line-type inkjet printing apparatus shown in FIG. 1A is described as an example. However, the present invention is not limited to this example. The present invention can also be applied to a serial-type printing apparatus that forms an image by moving a printing head relatively to a sheet in a direction intersecting with the direction in which nozzles are arrayed. If a printing head including a plurality of nozzle arrays capable of printing pixels having the same SEG number is used in the serial printing apparatus, the same ejection failure compensation process as that in the embodiments can be executed. In the case of a serial printing apparatus capable of adopting multi-pass printing of completing an image of a unit area in a print medium by a plurality of printing scans, an ejection failure compensation process equivalent to that in the embodiments can be executed by replacing the plurality of nozzle arrays with the plurality of printing scans. In short, the stable ejection failure compensation process can be realized while suppressing the influence of refill time of each nozzle and crosstalk between adjacent nozzles.

Further, the number of nozzles, the number of arrays, and the patterns of time division driving are described by citing the example of the printing head shown in FIGS. 1B, 11, and 24, but the present invention is not limited to this example.

Further, the conditions for a stable ejection state of each nozzle are shown in FIGS. 5A, 5B, 13A, 13B, and 21A to 21D, but the present invention is not limited to these conditions.

In either case, the advantageous result of the present invention can be achieved as long as print data can be allocated to a plurality of nozzle arrays or printing scans based on both the print data and the ejection failure data while satisfying conditions for maintaining a stable ejection state in each nozzle array.

(Other Embodiments)

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-156678 filed Aug. 9, 2016, which is hereby incorporated by reference herein in its entirety.

What is claimed is:

1. An inkjet printing apparatus using a printing head including a plurality of nozzle arrays each including a plurality of nozzles configured to eject ink and arrayed in a first direction, the nozzle arrays being arranged in a second direction intersecting with the first direction, to print an image on a print medium while relatively moving at least one of the printing head and the print medium in the second direction, the inkjet printing apparatus comprising one or more processors and one or more computer-readable media functioning as:

a generation unit configured to generate a plurality of items of print data corresponding to the plurality of the nozzle arrays, respectively, by allocating print data indicating whether or not to eject ink to each pixel on the print medium to the plurality of the nozzle arrays;

an acquisition unit configured to acquire information on a defective nozzle included in the printing head; and a compensating unit configured to compensate for an ejection failure of the defective nozzle by causing a compensating nozzle different from the defective nozzle to eject ink to a pixel area, on the print medium, to which ink is indicated to be ejected onto by the defective nozzle, wherein the compensating unit determines the compensating nozzle such that the following conditions are satisfied:

i) a first condition that the compensating nozzle is not a defective nozzle, and ii) a second condition that nozzles belonging to the nozzle array including the compensating nozzle do not eject ink to a pixel area corresponding to N pixels (N is a positive integer) around any pixel area to which ink is indicated to be ejected onto by the defective nozzle in the first direction.

2. The inkjet printing apparatus according to claim 1, wherein the compensating unit determines the compensating nozzle such that the following condition is further satisfied:

iii) a third condition that the compensating nozzle does not eject ink to M pixels (M is a positive integer) around any pixel area which ink is indicated to be ejected onto by the defective nozzle in the second direction.

3. The inkjet printing apparatus according to claim 1, wherein the compensating unit determines a plurality of compensating nozzle candidates from the plurality of nozzle arrays such that the first and second conditions are satisfied, and selects one of the compensating nozzle candidates as the compensating nozzle.

4. The inkjet printing apparatus according to claim 3, wherein the compensating unit selects one of the compensating nozzle candidates as the compensating nozzle based on priority information which defines priorities for the compensating nozzle.

5. The inkjet printing apparatus according to claim 4, wherein several of the nozzle arrays are located along the first direction and other nozzle arrays are located at different positions with respect to the first direction, and the priority information defines the priorities for the compensating nozzle such that a nozzle in a nozzle array located along the first direction with a nozzle array including the defective nozzle has a higher priority.

6. The inkjet printing apparatus according to claim 4, wherein the priority information defines the priorities for the compensating nozzle such that a nozzle in a nozzle array close to a nozzle array including the defective nozzle with respect to the second direction has a higher priority.

7. The inkjet printing apparatus according to claim 1, wherein after the compensating unit compensates for the ejection failure, the print data is defined such that a drive rate of each nozzle is less than 1/(N+1).

8. An inkjet printing apparatus using a printing head including a plurality of nozzle arrays each including a plurality of nozzles configured to eject ink and arrayed in a first direction, the nozzle arrays being arranged in a second direction intersecting with the first direction, to print an image on a print medium while relatively moving at least one of the printing head and the print medium in the second direction, the inkjet printing apparatus comprising one or more processors and one or more computer-readable media functioning as:

a generation unit configured to generate a plurality of items of print data corresponding to the plurality of the nozzle arrays, respectively, by allocating print data indicating whether or not to eject ink to each pixel on the print medium to any of the plurality of the nozzle arrays;

an acquisition unit configured to acquire information on a defective nozzle included in the printing head; and a compensating unit configured to compensate for an ejection failure of the defective nozzle by causing a compensating nozzle different from the defective nozzle to eject ink to a pixel area, on the print medium, to which ink is indicated to be ejected onto by the defective nozzle, wherein the compensating unit determines the compensating nozzle such that the following conditions are satisfied:

i) a first condition that the compensating nozzle is not a defective nozzle, and ii) a second condition that the compensating nozzle does not eject ink to M pixels (M is a positive integer) around any pixel area to which ink is indicated to be ejected onto by the defective nozzle in the second direction.

9. The inkjet printing apparatus according to claim 8, wherein the compensating unit determines a plurality of compensating nozzle candidates from the plurality of nozzle arrays such that the first and second conditions are satisfied, and selects one of the compensating nozzle candidates as the compensating nozzle.

10. The inkjet printing apparatus according to claim 9, wherein the compensating unit selects one of the compensating nozzle candidates as the compensating nozzle based on priority information which defines priorities for the compensating nozzle.

11. The inkjet printing apparatus according to claim 10, wherein several of the nozzle arrays are located along the first direction and the other nozzle arrays are located at different positions with respect to the first direction, and the priority information defines the priorities for the compensating nozzle such that a nozzle in a nozzle array located along the first direction with a nozzle array including the defective nozzle has a higher priority.

12. The inkjet printing apparatus according to claim 10, wherein the priority information defines the priorities for the compensating nozzle such that a nozzle in a nozzle array close to a nozzle array including the defective nozzle with respect to the second direction has a higher priority.

13. The inkjet printing apparatus according to claim 8, wherein after the compensating unit compensates for the ejection failure, the print data is defined such that a drive rate of each nozzle is less than 1/(M+1).

14. An inkjet printing method using a printing head including a plurality of nozzle arrays each including a plurality of nozzles configured to eject ink and arrayed in a first direction, the nozzle arrays being arranged in a second direction intersecting with the first direction, to print an image on a print medium while relatively moving at least one of the printing head and the print medium in the second direction, the inkjet printing method comprising the steps of:

generating a plurality of items of print data corresponding to the plurality of the nozzle arrays, respectively, by allocating print data indicating whether or not to eject ink to each pixel on the print medium to the plurality of the nozzle arrays;

acquiring information on a defective nozzle included in the printing head; and compensating for an ejection failure of the defective nozzle by causing a compensating nozzle different from the defective nozzle to eject ink to a pixel area, on the print medium, to which ink is indicated to be ejected onto by the defective nozzle, wherein the compensating step comprises determining the compensating nozzle such that the following conditions are satisfied:

i) a first condition that the compensating nozzle is not a defective nozzle and ii) a second condition that nozzles belonging to the nozzle array including the compensating nozzle do not eject ink to a pixel area corresponding to N pixels (N is a positive integer) around any pixel area to which ink is indicated to be ejected onto by the defective nozzle in the first direction.

15. The inkjet printing method according to claim 14, wherein the compensating step comprises determining the compensating nozzle such that the following condition is further satisfied:

iii) a third condition that the compensating nozzle does not eject ink to M pixels (M is a positive integer) around any pixel area which ink is indicated to be ejected onto by the defective nozzle in the second direction.

16. An inkjet printing method using a printing head including a plurality of nozzle arrays each including a plurality of nozzles configured to eject ink and arrayed in a first direction, the nozzle arrays being arranged in a second direction intersecting with the first direction, to print an image on a print medium while relatively moving at least one of the printing head and the print medium in the second direction, the inkjet printing method comprising the steps of:

generating a plurality of items of print data corresponding to the plurality of the nozzle arrays, respectively, by allocating print data indicating whether or not to eject ink to each pixel on the print medium to the plurality of the nozzle arrays;

acquiring information on a defective nozzle included in the printing head; and compensating for an ejection failure of the defective nozzle by causing a compensating nozzle different from the defective nozzle to eject ink to a pixel area, on the print medium, to which ink is indicated to be ejected onto by the defective nozzle, wherein the compensating step comprises determining the compensating nozzle such that the following conditions are satisfied:

i) a first condition that the compensating nozzle is not a defective nozzle, and ii) a second condition that the compensating nozzle does not eject ink to M pixels (M is a positive integer) around any pixel area to which ink is indicated to be ejected onto by the defective nozzle in the second direction.

* * * * *